US010625931B2

(12) United States Patent
Mekata et al.

(10) Patent No.: US 10,625,931 B2
(45) **Date of Patent: *Apr. 21, 2020**

(54) TWO-FLUID DISCHARGE CONTAINER

(71) Applicant: DAIZO CORPORATION, Osaka-shi, Osaka (JP)

(72) Inventors: Satoshi Mekata, Osaka (JP); Kimio Kataoka, Kyoto (JP)

(73) Assignee: DAIZO CORPORATION, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/130,731

(22) Filed: Sep. 13, 2018

(65) Prior Publication Data

US 2019/0016524 A1 Jan. 17, 2019

Related U.S. Application Data

(62) Division of application No. 15/033,058, filed as application No. PCT/JP2014/078973 on Oct. 30, 2014, now Pat. No. 10,106,311.

(30) Foreign Application Priority Data

Oct. 31, 2013 (JP) ..... 2013-227597
May 2, 2014 (JP) ..... 2014-095514

(51) Int. Cl.
*B65D 83/68* (2006.01)
*B65D 81/32* (2006.01)
(Continued)

(52) U.S. Cl.
CPC ..... *B65D 83/682* (2013.01); *B65D 81/325* (2013.01); *B65D 83/384* (2013.01);
(Continued)

(58) Field of Classification Search
CPC .... B65D 83/682; B65D 83/68; B65D 83/663; B65D 83/384; B65D 81/325
(Continued)

(56) References Cited

U.S. PATENT DOCUMENTS 3,217,936 A 11/1965 Abplanalp
3,258,163 A * 6/1966 Brush ..... B65D 83/663 222/399
(Continued)

FOREIGN PATENT DOCUMENTS

DE 10132417 A1 1/2003
JP S63-87 A 1/1988
(Continued)

OTHER PUBLICATIONS

International Search Report issued in corresponding International Application No. PCT/JP2014/078973, dated Feb. 10, 2015.
(Continued)

*Primary Examiner* — Jeremy Carroll
(74) *Attorney, Agent, or Firm* — McDermott Will & Emery LLP

(57) ABSTRACT

Provided is a two fluid discharge container comprising: a container body; a piston partitioned by a first storage part and a second storage part, which are accommodated in the container body and are each to be filled with content, and a pressurized space to be filled with a pressurizing agent; and a valve mechanism that closes an opening in the container body, and has a passage through which the first storage part and the second storage part communicate. The first storage part and the second storage part are concentrically formed, and the contents of the first storage part and the second storage part are simultaneously pressurized by the piston so as to be discharged.

8 Claims, 21 Drawing Sheets

(51) Int. Cl.

| | |
|---|---|
| ***B65D 83/38*** | (2006.01) |
| ***B65D 83/42*** | (2006.01) |
| ***B65D 83/62*** | (2006.01) |
| ***B65D 83/64*** | (2006.01) |

(52) U.S. Cl.
CPC ..... *B65D 83/42* (2013.01); *B65D 83/425* (2013.01); *B65D 83/62* (2013.01); *B65D 83/64* (2013.01); *B65D 83/646* (2013.01)

(58) Field of Classification Search
USPC ..... 222/136
See application file for complete search history.

(56) References Cited

U.S. PATENT DOCUMENTS

| | | | | |
|---|---|---|---|---|
| 3,813,011 | A | 5/1974 | Harrison et al. | |
| 4,220,261 | A | 9/1980 | White | |
| 4,801,046 | A | 1/1989 | Miczka | |
| 7,506,783 | B2 * | 3/2009 | Brennan | B05C 17/00553 222/137 |
| 9,624,021 | B2 * | 4/2017 | Bodet | B65D 81/325 |
| 2007/0125809 | A1 | 6/2007 | Regan et al. | |
| 2008/0054020 | A1 | 3/2008 | Pierson et al. | |
| 2013/0168413 | A1 | 7/2013 | Bodet et al. | |
| 2013/0299515 | A1 * | 11/2013 | Geiberger | B05B 11/0078 222/136 |
| 2015/0122836 | A1 | 5/2015 | Bodet et al. | |

FOREIGN PATENT DOCUMENTS

| | | | |
|---|---|---|---|
| JP | 2000-142822 | A | 5/2000 |
| JP | 3338447 | B2 | 10/2002 |
| JP | 2003-040368 | A | 2/2003 |
| JP | 2003-516911 | A | 5/2003 |
| JP | 2003-526438 | A | 9/2003 |
| JP | 2007-519578 | A | 7/2007 |
| JP | 2009-536850 | A | 10/2009 |
| WO | 93/04940 | A1 | 3/1993 |
| WO | 01/44065 | A1 | 6/2001 |
| WO | 01/67961 | A1 | 9/2001 |
| WO | 2007/109229 | A2 | 9/2007 |
| WO | 2012/022685 | A1 | 2/2012 |
| WO | 2012/022686 | A1 | 2/2012 |

OTHER PUBLICATIONS

Extended European Search Report issued in corresponding European Patent Application No. 14858739.7, dated Jun. 13, 2017.
Office Action issued in corresponding Chinese Patent Application No. 201480058464.6, dated Jun. 20, 2017.
Non-final Office Action dated Nov. 15, 2017 in U.S. Appl. No. 15/033,058.
Notice of Allowance dated Jun. 13, 2018 in U.S. Appl. No. 15/033,058.
Notice of Reasons for Refusal issued in corresponding Japanese Application No. 2019-014973, dated Nov. 12, 2019, with English translation.

* cited by examiner

TWO-FLUID DISCHARGE CONTAINER

CROSS REFERENCE

This application is divisional application of U.S. patent application Ser. No. 15/033,058, filed Apr. 28, 2016, which is the U.S. National Phase under 35 U.S.C. § 371 of International Application No. PCT/JP2014/078973, filed on Oct. 30, 2014, which claims the benefit of Japanese Application No. 2014-095514, filed on May 2, 2014, and Japanese Application No. 2013-227597, dated Oct. 31, 2013, the entire contents of each are hereby incorporated by reference.

FIELD OF INVENTION

The present invention relates to a two-fluid discharge container. For details, a two-fluid discharge container equipped with two storage portions where two kinds of contents are filled in one container body separately, and the two kinds of the contents are simultaneously pressurized and discharged.

DESCRIPTION OF BACKGROUND ART

There are units of Patent Documents 1, 2 in which two contents are housed in one container, and those two contents are simultaneously discharged by separate independent pistons.

The discharge device of a plurality of contents of Patent Document 1 consists of a pressure resistant container, a cylinder housed therein, two pistons which partition the space inside of the cylinder into a first chamber and a second chamber, and a valve which communicates the first chamber and the second chamber with the exterior. A propellant (pressurizing agent) is filled between a second piston inserted into the bottom portion side of the container and the bottom portion of the container, and by the pressure of the pressurizing agent, the second piston is pushed applying a pressure to the second chamber, and by the pressure applied to the second chamber, a first piston is pushed applying pressure to the first chamber, thereby each content is discharged. In the device of distributing two kinds of fluid materials of Patent Document 2, a first material supplying chamber and a second material supplying chamber are provided concentrically, and a first pump and a second pump which operate separately are provided.

Meanwhile, there are Patent Documents 3, 4 in which two pistons to push out two contents are connected to operate integrally (not independently), pushing out two contents simultaneously.

In the dispenser for an adhesive tissue sealant of Patent Document 3, two cylinders for housing contents are provided side by side. A movable plug is provided freely slidably in those cylinders respectively. The rear ends of those two movable plugs are connected integrally. Hence, the two movable plugs are pushed to move integrally, pushing out two contents simultaneously.

The foldable distributor of Patent Document 4 is that which is equipped with a cartridge and a container consisting of two foldable chambers housed inside thereof. A filling gun is attached to this distributor, and a thrust back wall (piston) is operated so as to contract the chamber, two contents are pushed out simultaneously.

The content pushing out device of Patent Document 5 consists of an inner cylinder and a body cylinder of a double cylinder structure having the inner cylinder and an outer cylinder arranged coaxially with the inner cylinder.

The inside of the inner cylinder is a first housing portion and between the inner cylinder and the outer cylinder is a second housing portion. A spout is provided in the tip of the cylinder body, communicating with the first housing portion and the second housing portion. An operation cylinder is attached to the outside of the back end of the cylinder body. A male screw is formed in the outer periphery surface of the cylinder body, and a female screw meshing with the male screw is formed in the inner periphery surface of the operation cylinder. In the operation cylinder, pistons are integrally provided, which proceed to the first housing portion and the second housing portion respectively by the relative movement in the axial direction and push out two kinds of contents simultaneously from the spout.

PRIOR ART DOCUMENTS

Patent Documents

Patent Document 1: Japanese Unexamined Patent Application Publication No. 2003-40368
Patent Document 2: Japanese Patent No, 3338447
Patent Document 3: Japanese Unexamined Patent Application Publication No. 2003-526438
Patent Document 4: Japanese Unexamined Patent Application Publication No. 2003-516911
Patent Document 5: Japanese Unexamined Patent Application Publication No. 2000-142822

DESCRIPTION OF THE INVENTION

Problems to be Solved

In a device in which two contents are pressed by independent two pistons (for example, Patent Document 1, 2), if the viscosity of the content is different, even the same pressurizing agent is utilized, there occurs the difference of the moving amount of the pistons, making the discharge amount ratio of the contents changeable. Hence, it is difficult to discharge at a designed discharge amount ratio, and particularly, to discharge at an equal amount.

In the container which presses two contents by an integrated piston (for example, Patent Document 3, 4), since the operating quantity of the piston is same, the contents are easy to be discharged equally, but since the piston or plunger of the same volume as the volume of the housing portion housing two contents protrudes to the exterior, the whole of the device is bulky, being not easy to use. Moreover, the pressure of a pressurizing agent is not used, when the content is a viscous material such as cream or gel, it is particularly difficult to press.

Thereupon, the present invention is that which utilizes the pressing force of a pressurizing means for two contents, and aimed to provide a two-fluid discharge container being easy of discharging operation and being capable of discharging a plurality of contents at a constant discharge ratio.

Means of Solving the Problem

The two-fluid discharge container of the present invention comprises a container body, and a piston accommodated in the container body partitioning the container body into a compressing space equipped with a first storage portion in which a first content is filled and a second storage portion in which a second content is filled, and a pressurizing space in which a pressurizing means is housed, having a valve assembly which closes the opening portion of the container body, provided with a passage which communicates the first storage portion, the second storage portion with the exterior, in which the piston is provided with a first pressurizing portion which pressurizes the first storage portion, a second pressurizing portion which pressurizes the second storage portion, and a connecting portion which connects the first pressurizing portion and the second pressurizing portion, and in which the contents of the first storage portion and the second storage portion are simultaneously pressurized and discharged by the piston.

In the two-fluid discharge container of the present invention, it is preferable that the first pressurizing portion is a first piston portion sliding within the first storage portion, and the second pressurizing portion is a second piston portion sliding within the second storage portion.

As the two-fluid discharge container of the piston type, it can be preferably cited that the first storage portion and the second storage portion are provided concentrically (piston first type), and the first storage portion is a columnar space and the second storage portion is a tubular space, and the first storage portion is arranged within the center hole of the second storage portion in the planar view (piston second type) or the first storage portion and the second storage portion are provided in parallel (piston third type).

As the two-fluid discharge container of the piston first, second type, that in which the first storage portion and the second storage portion are arranged so as to be deviated in an axial direction or the first storage portion and the second storage portion are in the same position in the axial direction can be preferably cited.

In the case of the piston first type of the present invention, the outer periphery diameter r of the first storage portion in the center axis side and the outer periphery diameter R of the second storage portion in the outer side is preferable to be in a relation expressed by the following formula.

[Mathematic Formula 1]

$$R=\sqrt{2}\cdot r \qquad \text{(Formula)}$$

In the two-fluid discharge container of the piston first, second type, it is preferable that the first storage portion and the second storage portion are partitioned by the piston.

In the case of being partitioned by the piston, it is preferable that the container body has a body portion whose inner diameter is thin, a body portion whose inner diameter is thick, and a step portion provided between those, and in which the piston is a convex body provided with a tubular main body portion sliding on the inner surface of the thin body portion and a flange portion sliding on the inner surface of the thick body portion, being provided in the outer periphery of the main body portion, and in which the tip of the main body portion constitutes a first piston portion and the flange portion constitutes a second piston portion.

Moreover, it is preferable that there is provided a cylinder member constituting the first storage portion and the second storage portion, being accommodated in the container body, the cylinder member having a cylinder body portion whose inner diameter is thin and a cylinder body portion whose inner diameter is thick, and a step portion provided between those, in which the piston is a convex body provided with a tubular body portion sliding on the inner surface of the thin cylinder body portion and a flange portion provided in the outer periphery of the main body portion, sliding on the inner surface of the thick body portion, being provided in the outer periphery of the main body, and in which the tip of the main body portion constitutes a first piston portion and the flange portion constitutes the second piston portion.

In this case, the tip of the main body portion is preferable to be made up of different materials. And, it is preferable that a sliding layer is provided on the inner periphery surface of the body portion whose inner diameter is thin.

Moreover, it is preferable that there is provided a communication passage which communicates the valve assembly and the second storage portion between the inner periphery surface of the body portion whose inner diameter is thin and the outer periphery surface of the sliding layer, the communication passage constituting a passage to communicate the second storage portion with the exterior.

In the two-fluid discharge container of the piston first, second type, in which the first storage portion and the second storage portion are arranged so as to be the same position in the axial direction, it is preferable that the first storage portion and the second storage portion are partitioned by a tubular partition wall provided so as to be concentric with the first storage portion and the second storage portion.

In this case, it is preferable that the innermost layer and the outermost layer are made up of different materials. Furthermore, it is preferable that the partition wall is of a multi-layered structure, and there is provided a passage for charging gas between the layers of the partition wall.

In this case, it is preferable that the piston is equipped with a disc-like first piston portion, a ring-like second piston portion provided in the outer periphery of the same position in the radial direction, and a connecting portion which connects the first piston portion and the second piston portion, and in which the connecting portion has an inner wall extending from the outer edge portion of the first piston and an outer wall extending from the inner edge of the second piston, the partition wall moving vertically along with the vertical motion of the piston.

In the two-fluid discharge container of the piston third type of the present invention, it is preferable that two cylinder members are accommodated in the container body, the inside of each cylinder constituting the first storage portion and the second storage portion. Moreover, it is preferable that the piston and/or the cylinder members are supported on the inner surface of the container body.

In the two-fluid discharge container of the present invention, it is preferable that there is provided the first storage portion and the second storage portion which extend and contract vertically, the first storage portion being equipped with a first bellows portion extending and contracting vertically, the second storage portion being equipped with a second bellows portion extending and contracting vertically, and in which the piston presses a first bottom portion of the first storage portion and a second bottom portion of the second storage portion, and in which the first storage portion and the second storage portion extend and contract vertically in a state superimposed in parallel, where the mountain part of the second bellows portion is inserted into the valley part of the first bellows portion and the mountain part of the first bellows portion is inserted into the valley part of the second bellows portion (extending and contracting vertically type).

In the two-fluid discharge container of extending and contracting vertically of the present invention, it is preferable that the piston is supported on the inner surface of the container body. Moreover, it is preferable that there is provided a film stretched around the outer periphery of the first storage portion and the second storage portion which are in the state superimposed in parallel.

As the pressurizing means of the two-fluid discharge container of the present invention, a pressurizing agent, or an elastic member (particularly, spring) can be preferably cited. In the case that the pressurizing agent is used, it is preferable that a regulating mechanism to make constant the pressing pressure of the piston is provided. In the two-fluid discharge container of the present invention, it is preferable that the pressurizing means is a spring.

As the valve assembly of the two-fluid discharge container of the present invention, that which is equipped with a stem for two-fluid discharge having two independent passages, or equipped with two stems can be preferably cited.

Effect of the Invention

The two-fluid discharge container of the present invention comprises a container body, and a piston accommodated in the container body which partitions the container body into a compressing space equipped with a first storage portion in which a first content is filled and a second storage portion in which a second content is filled, and a pressurizing space in which a pressurizing means is housed, having a valve assembly which closes the opening portion of the container body, and is provided with a passage which communicates the first storage portion and the second storage portion with the exterior, and in which the piston is provided with a first pressurizing portion which pressurizes the first storage portion, a second pressurizing portion which pressurizes the second storage portion, and a connecting portion which connects the first pressurizing portion and the second pressurizing portion. Hence, the contents in the first storage portion and the second storage portion are simultaneously pressed and discharged, and the discharging operation is easy, making the whole discharge container compact, while having the pressurizing space.

Furthermore, since the two fluids are simultaneously pressed by the one or integrated piston, it is possible to discharge the contents at a constant ratio, even if the viscosity of the contents is different in some degree.

In addition, the meaning of "pressing and discharging the contents simultaneously" is that utilizing the pressure of the pressurizing agent to move the one or integrated piston, the contents filled in the separate space are simultaneously pressed and discharged.

In the two-fluid discharge container as described above, when the pressurizing means is a pressurizing agent or a spring, it is not necessary to make the shape of the pressurizing space to be a specific structure.

The structure of the two-fluid discharge container of the present invention can be used for a three-fluid discharge container which discharges three or more contents or for a plural-fluid discharge container.

In the two-fluid discharge container of the present invention, when the first pressurizing portion is a first piston portion sliding within the first storage portion, and the second pressurizing portion is a second piston portion sliding within the second storage portion, it is possible to press two storage portions simultaneously by the piston of a simple structure, and the moving distance of the two pistons can be equalized making the discharge amount ratio constant.

In the two-fluid discharge container of the piston type, when the first storage portion and the second storage portion are provided concentrically. (piston first type 1), the resistance applied to the piston is equalized, making the piston hard to incline. In the two-fluid discharge container of the piston type, when the first storage portion is a columnar space and the second storage portion is a tubular space, and the first storage portion is arranged in the center hole of the second storage portion in the planar view (piston second type 2), the resistance applied to the piston is equalized, making the piston hard to incline. In addition, in this case, the axis of the first storage portion and the axis of the second storage portion may be either coaxial or non-coaxial.

In the two-fluid discharge container of the piston type, when the first storage portion and the second storage portion are provided in parallel (piston third type), it can be made to be a simple structure.

In the two-fluid discharge container of the piston first, second type, when the first storage portion and the second storage portion are deviated in the axial direction, since the contents can be housed apart from each other in the axial direction, two-liquid reactive type contents such as two-liquid type hair dye, two-liquid type urethane foam can be stored stably.

In the two-fluid discharge container of the piston first, second type, when the first storage portion and the second storage portion are arranged so as to be the same position in the axial direction, the first storage portion and the second storage portion can be adjoined, making the whole compact, In the two-fluid discharge container of the piston first, second type, when the outer periphery diameter r of the first storage portion in the center axis side, and the outer periphery diameter R of the second storage portion in the outer side are in a relation expressed by the following formula, the two contents can be discharged at an equal amount.

[Mathematic Formula 1]

$$R=\sqrt{2}\cdot r \qquad \text{(Formula)}$$

In the two-fluid discharge container of piston first, second type, in which the first storage portion and the second storage portion are deviated in the axial direction, when the first storage portion and the second storage portion are partitioned by the piston, the inside of the container body can be made to be a simple structure.

In the present invention partitioned by the piston, when the container body has a body portion whose inner diameter is thin and a body portion whose inner diameter is thick, and a step portion provided between those, in which the piston is a convex body (inverse T letter type) provided with a tubular body portion sliding on the inner surface of the thin body portion and a flange portion sliding on the inner surface of the thick body portion, being provided in the outer periphery of the main body portion, and in which the tip of the main body portion constitutes a first piston portion and the flange portion constitutes the second piston portion, the piston is prevented from inclining by the tubular main body portion when it moves vertically, being capable of smooth movement, making the discharge amount easy to be stable.

In the present invention partitioned by the piston, when there is provided a cylinder member constituting the first storage portion and the second storage portion, being accommodated in the container body, the cylinder member having a cylinder body portion whose inner diameter is thin and a cylinder body portion whose inner diameter is thick, and a step portion provided between those, where the piston is a convex body (inverse T letter type) provided with a tubular main body portion sliding on the inner surface of the thin cylinder body portion and a flange portion sliding on the inner surface of the thick cylinder body portion, being provided in the outer periphery of the main body portion, and where the tip of the main body portion constitutes a first piston portion and the flange portion constitutes the second piston portion, the movement of the piston becomes stable similar to that which is provided with the above described convex body piston.

When the piston is equipped with a center hole sliding with the tube of the valve assembly on the center axis, the piston is prevented from inclining by the outer periphery and the center axis when moving vertically, being capable of smooth movement, making the discharge amount easy to be stable. Particularly, when the piston is equipped with a lateral passage way communicating with the second storage portion at the side surface thereof, since the contents are introduced to the center axis side of the piston and are pushed out, the discharge amount is easy to be stable. When the tip of the main body portion and the flange portion are made up of different materials, by properly selecting the material quality according to the contents, the contents can be stored for a long period. When there is provided a sliding layer on the inner periphery surface of the body portion of the cylinder member whose inner diameter is thin, by properly selecting the material quality according to the contents, the contents can be stored stably. When there is provided a communication passage which communicates the valve assembly and the second storage portion between the inner periphery surface of the body portion whose inner diameter is thin and the outer periphery surface of the sliding layer, and the communication passage constituting a passage to communicate the second storage portion with the exterior, the communication passage can be simplified.

In the two-fluid discharge container of the piston first, second type where the first storage portion and the second storage portion are arranged to be the same position in the axial direction, when the first storage portion and the second storage portion are partitioned by a tubular partition wall provided so as to be concentric with the first storage portion and the second storage portion, since the contents can be independently housed by the partition wall, reactive contents such as two-liquid type hair dyes can be stored stably. Particularly, when the partition wall is of a multi-layered structure, and the outermost layer and the innermost layer of the partition wall is made up of different materials, by selecting properly the material quality of the partition wall, the contents can be stored more stably. When the partition wall is of a multi-layered structure, and there is provided a passage for charging gas between the layers of the partition wall, the filling of pressurizing agents becomes easy.

Moreover, when the piston is equipped with a first piston portion, a second piston portion provided in the outer periphery of the same position in the radial direction, and a connecting portion which connects the first piston portion and the second piston portion, and in which the connecting portion has an inner wall extending from the outer edge portion of the first piston and an outer wall extending from the inner edge of the second piston, and a connecting bridge which connects those tips, the partition wall moving vertically between the outer wall and the inner wall along with the vertical motion of the piston, at the moment that the piston moves vertically, the first piston portion and the second piston portion are prevented from inclining, thereby the piston moves smoothly, the discharge amount becomes easy to be stable.

In the two-fluid discharge container of the piston third type of the present invention, when two cylinder members are accommodated in the container body, the inside of each cylinder constituting the first storage portion and the second storage portion, the contents stored in the first storage portion and the second storage portion can be accommodated in the independent cylinder respectively, each content can be stored stably.

When the piston and the cylinder members are supported on the inner surface of the container body, since the axis of the piston and/or the cylinder member does not move radially in the container body, the discharge container becomes highly reliable.

In the two-fluid discharge container of the present invention, when there is provided the first storage portion and the second storage portion accommodated in the compressing space, extending and contracting vertically, the first storage portion being equipped with a first bellows portion extending and contracting vertically, the second storage portion being equipped with a second bellows portion extending and contracting vertically, and in which the piston presses a first bottom portion of the first storage portion and a second bottom portion of the second storage portion, and in which the first storage portion and the second storage portion extend and contract vertically in the state superimposed in parallel, where the mountain part of the second bellows portion is inserted into the valley part of the first bellows portion and the mountain part of the first bellows portion is inserted into the valley part of the second bellows portion, since the first storage portion and the second storage portion extend and contract constraining each other, the degree of contraction (the moving distance of the first pressing portion and the second pressing portion) can be made same more stably. Stated differently, the contents can be more stably discharged at a constant discharge ratio to the last. Furthermore, even if the communication passage is released only for either the first storage portion or the second storage portion, since the first bellows portion and the second bellows portion are in the state of being superimposed in parallel, constraining the one side, it never occurs that the one side only is discharged even when used improperly.

Moreover, since the storage portions extend and contract vertically, the whole can be made compact.

In the two-fluid discharge container of extending and contracting vertically type of the present invention, when the piston is supported on the inner surface of the container body, the vertical movement of the piston becomes stable.

In the two-fluid discharge container of extending and contracting vertically type of the present invention, when there is provided a film stretched around the outer periphery of the first storage portion and the second storage portion being in the state superimposed in parallel, it never occurs that only one of the storage container accommodated in the container body inclines, and that the first storage portion and the second storage portion become separated. Moreover, it can be assembled simply.

When, as the pressurizing means of the two-fluid discharge container of the present invention, a pressurizing agent is used, the pushing force of the whole piston can be uniformed. When there is provided a regulating mechanism to make constant the pressing pressure of the piston, since if the pressure of the pressurizing space becomes low because of discharge, the pressure can be restored by the regulating mechanism, the discharge amount per unit of time can be made constant regardless of the remaining amount of the contents. Particularly, it is preferable when a compressed gas is used. When, as the pressurizing means of the two-fluid discharge container of the present invention, an elastic member, particularly, a spring is used, the assembling is easy.

In the two-fluid discharge container of the present invention, when the valve assembly is equipped with a stem for two-fluid discharge having two independent passages, since two independent passages can be securely released by only moving two stems vertically downward, it is easily operated. In addition, when the stem for two-fluid discharge is made to be a tilting type, the two independent passages can be securely released only by tilting the stem.

When the valve assembly of the two-fluid discharge container of the present invention is equipped with two stems, the piston does not move unless the two storage portions are simultaneously released by operating the two stems. Hence, in such a case that consumers do not perform the operation procedure as designed such that they pushed down only one side stem, the contents cannot be discharged, preventing improper use and use under a low performance. Furthermore, two independent passages in the valve assembly can be designed to be set apart from each other, the contact of two liquid contents due to the infiltration of the contents in the valve assembly can be prevented further. Hence, the reactive contents such as two-liquid type hair dyes and two-liquid type urethane foams can be stored for a long period without deteriorating the performance. Particularly, after being used once, even if contents of the two liquids coexist in the valve assembly, the deterioration of the performance can be prevented.

EMBODIMENT FOR CARRYING OUT THE INVENTION

Figure 1:
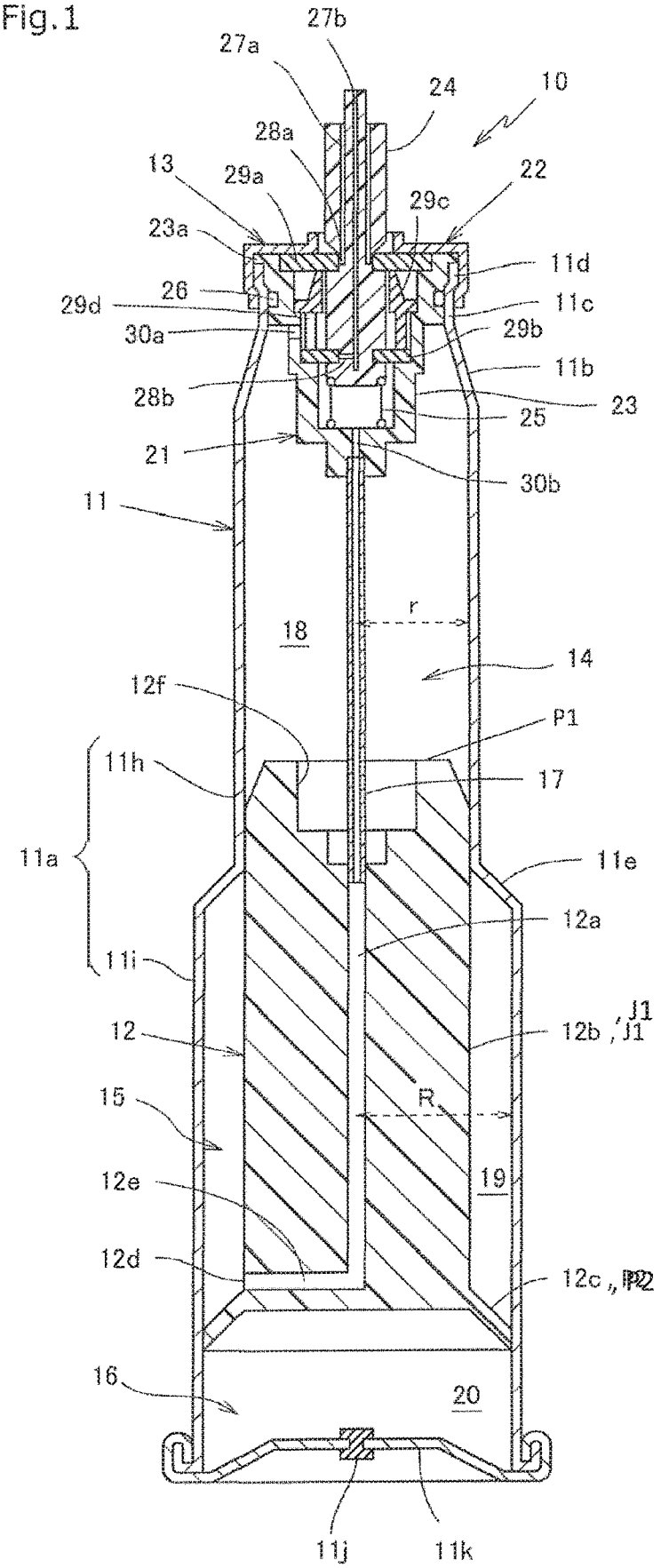
FIG. 1 is a cross-sectional view showing an embodiment of the two-liquid type discharge container of the piston coaxial type of the present invention.

The two-liquid discharge container 10 shown in FIG. 1 is that in which the two storage portions are deviated vertically and is that which is the piston first type and the piston second type also. In detail, it is an aerosol container provided with a container body 11, a piston 12 which partitions the internal space into a compressing space storing the contents and a pressurizing space housing the pressurizing means in the vertical direction, and a valve assembly 13 which closes the upper end opening of the container body 11 and performs communication/shutoff between the compressed space and the exterior. The piston 12 partitions the compressed space also into the first storage portion and the second storage portion.

Stated differently, the piston 12 partitions the internal space into three spaces in the vertical direction. In detail, it partitions closely the internal space of the container 11 into an upper storage portion (first storage portion) 14 at the top, a lower storage portion (second storage portion) 15 at the side outer periphery, and a pressurizing agent housing portion (pressurizing portion) 16 at the bottom. The first storage portion 14 and the second storage portion 15 are formed coaxially, and deviated in the axial direction. In the inside of the piston 12, a central hole 12*a* extending in the vertical direction in the center axis is formed, and in the center hole 12*a*, a tube 17 provided in the lower end of the valve assembly 13 is inserted freely slidably. The center hole 12*a* and the tube 17 communicate the valve assembly 13 with the lower storage portion 15.

In the two-fluid discharge container 10 as described above, a first liquid content 18 and a second liquid content 19 are filled in the upper storage portion 14 and the lower storage portion 15 respectively, and a pressurizing agent 20 is filled in the pressurizing agent housing portion 16, making a two-fluid discharge product.

The container body 11 is a pressure resistant container made of metal equipped with a cylindrical body portion 11*a*, a taper-like shoulder portion 11*b* formed in the upper end of the body portion, a cylindrical neck portion 11*c* formed in the upper end of the shoulder portion, and a diameter-expanded mouth portion 11*d* in the upper part of the neck portion. In the lower end of the body portion 11*a*, a bottom lid (bottom portion) 11*k* equipped with a valve 11*j* for filling the pressurizing agent is firmly fixed in the central portion. Further, the body portion 11*a* appears to be a stepwise shape of two stages consisting of a thin body portion (first body portion) 11*h* upper than the center and thick body portion (second body portion) 11*i* lower than the center wholly, and a diameter-expanded step portion 11*e* is provided between the both. The diameter-expanded step portion 11*e* is directed outward in the radial direction and inclines obliquely downward.

In addition, in the embodiment where the first storage portion and the second storage portion are deviated in the axis direction (vertical direction), it is sufficient that the container body 11 is equipped with at least the body portion 11*a* having the thin body portion 11*h* and the thick body portion 11*i*, and another constitutions are not particularly limited. For example, it is sufficient that the bottom portion 11*k* is not equipped with the valve 11*j*. The shoulder portion, neck portion, and mouth portion may be omitted and the upper end of the body portion may be made as an opening portion. Further, the constitution of the upper opening portion of the body portion 11 is not particularly limited as long as the valve assembly 13 can be fixed.

The piston 12 is of a convex-shaped body (inverted T shape) consisting of a columnar body portion 12*b* and a flange portion 12*c* formed in the lower periphery of the main body portion 12*b*. The main body portion 12*b* slides on the inner periphery surface of the thin body portion 11*h* with its whole outer periphery surface. The upper end surface of the main body portion 12*b* acts as the first piston portion P1 pressurizing the first content 18 in the upper storage portion 14. Moreover, in the upper end surface, a recessed portion 12*f* so as to be engageable with the lower end of a housing 23 of a valve mechanism 21 described later is formed.

Figure 2:
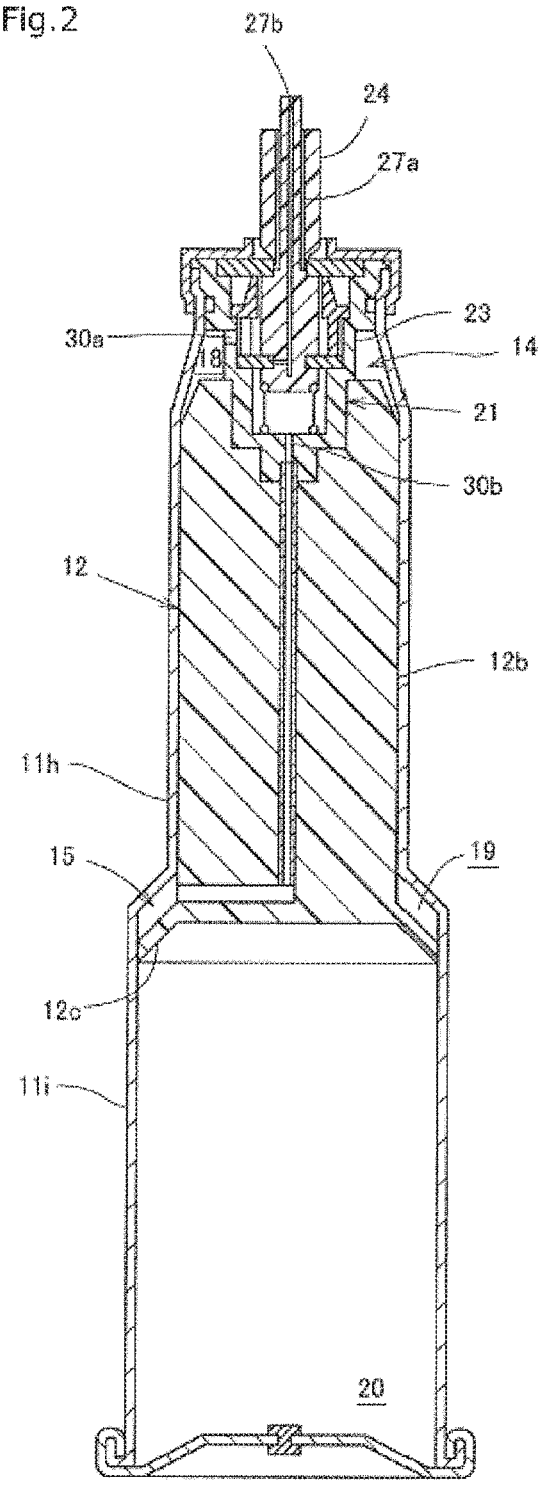
FIG. 2 is a cross-sectional view showing the operated state of the two-liquid discharge container of FIG. 1.

As described above, by providing the recessed portion 12*f*, the upper storage portion 14 can be securely contracted (refer to FIG. 2). And, the flange portion 12*c* slides on the inner periphery surface of the thick body portion 11*i* with its vicinity of circumference. The upper surface of the flange portion 12*c* acts as the second piston P2 pressurizing the second content 19 in the lower storage portion 15. And, the main body portion 12*b* acts as a connecting portion J1 which connects the first piston portion P1 and the second piston portion P2. These slidings are performed while maintaining a liquid-tight state. Further, a hole 12*d* is formed in the lower side surface of the body portion 12*b* which is communicated with the center hole 12*a* through a lateral passage 12*e*.

The upper storage portion 14 is within the thin body portion 11*h*, being a columnar space surrounded by the upper end surface of the body portion 12*b* and the valve assembly (lid portion) 13. And the lower storage portion 15 is within the thick body portion 11*i*, being a cylindrical space surrounded by the lower surface of an expanded diameter step portion 11*e*, the outer periphery surface of the main body portion 12*b*, and the upper surface of the flange portion 12*c*. Further, a pressurizing agent housing portion 16 is within the thick body portion 11*i*, being a columnar space surrounded by the lower surface of the main body portion 12*b*, the lower surface of the flange portion 12*c*, and the bottom lid 11*k*. These three spaces are provided coaxially with the center axis of the container body 11.

These upper storage portion 14 and the lower storage portion 15 are arranged so as to be deviated in the vertical direction in the front view (refer to FIG. 1), but in the top view, they are arranged coaxially where the first storage portion 14 is arranged in the center hole of the second storage portion 15. In detail, in the top view, those are the circular upper storage portion 14 being in the center and the lower storage portion 15 adjoining the outer periphery thereof. And, the ratio of the cross-sectional area of the upper storage portion 14 and the lower storage portion 15 is made so as to correspond to the discharge amount ratio. In the case of the same amount discharge, the cross-sectional area is made to be the same, where the diameter r of the thin body portion 11*h* and the diameter R of the thick body portion 11*i* satisfy the relation of the following formula.

[Mathematic Formula 1]

$$R=\sqrt{2}\cdot r \qquad \text{(Formula)}$$

The tube 17 is a pipe having stiffness property such as synthetic resin of polyethylene, polypropylene, metal such as stainless pipe, and is freely slidable vertically within the center hole 12*a*, being housed within the center hole 12*a* when the piston 12 moves upward, while maintaining liquid-tightness.

The valve assembly 13 is equipped with a valve mechanism 21 which communicates/shuts off a first passage connecting the upper storage portion 14 and the exterior, and a second passage connecting the lower storage portion 15 and the exterior, and a cover cap 22 for fixing the valve mechanism 21 to the opening portion of the container body 11. The valve assembly 13 acts also as a lid portion of the container body 11.

The valve mechanism 21 is equipped with a bottomed tubular housing 23, a stem 24 accommodated so as to be freely movable vertically inside thereof, and a spring 25 which energizes the stem 24 upward. In the upper portion of the housing 23, an upper end flange 23*a* is provided, and is fixed so as to be sandwiched between the upper end of the opening 11*d* of the container body and the cover cap 22. In the upper periphery surface of the housing 23, a seal member 26 (O ring) which seals the inner surface of the opening portion (the neck portion 11*c*) of the container body 11 is provided. The stem 24 is a stem for two-fluid discharge having a configuration where a somewhat smaller diameter tube is coaxially inserted into an outer tube through a gap so that the upper end protrudes. The gap between a large diameter tube and a small diameter tube is a first intra-stem passage 27*a* communicating with the upper storage portion 14 through the upper space of the housing 23. The center hole of the small diameter tube is a second intra-stem passage 27*b* communicating with the lower storage portion 15 through the lower space of the housing 23 and the tube 17. In addition, as the stem for two-fluid discharge, it is not particularly limited as long as it has two independent passages. Moreover, a valve mechanism for two fluids having two stems may be applied. In this case, it can be actualized so that it is made to be a valve mechanism equipped with a first valve structure which makes the first storage portion 14 communicate with one side of the stem and makes its passage communicated/shut off, and a second valve structure which makes the second storage portion 15 communicate with the other stem, and makes its passage communicated/shut off.

The lower end of the first intra-stem passage 27*a* communicates with a first stem hole 28*a* extending in the radial direction, the lower end of the second intra-stem passage 27*b* communicates with a stem hole 28*b* lower side than the first stem hole 28*a*. And, the first stem hole 28*a* and the second stem hole 28*b* are closed by a first stem rubber 29*a* and a second stem rubber 29*b*, and those are made to be opened when the stem 24 moves downward. In addition, the first stem rubber 29*a* and the second stem rubber 29*b* are supported by a tubular support member 29*c* provided between those so as to be provided with an interval. In the support member 29*c*, a slit 29*d* communicating the inside and outside of the support member 29*c* is formed. Stated differently, the first passage of a valve mechanism 21 reaches an upper communication hole 30*a* formed in the side wall of the housing 23 communicated with an upper storage portion 14 through the upper space (the space between the first stem rubber 29*a* and the second stem rubber 29*b*) of the housing 23 from the first intra-stem passage 27*a*. Meanwhile, the second passage of the valve mechanism 21 reaches the tube 17 communicating with the lower storage portion 15 from the second intra-stem passage 27*b*, through the lower space (lower space than the second stem rubber 29*b*) of the housing 23, and a lower communication hole 30*b* of the lower end of the housing 23.

The cover cap 22 is that in which a metal thin plate made of aluminum etc. is pressed so as to be cup-shaped. While an upper end flange 23*a* of the housing is pressed against the mouth portion 11*d* of the container body, the outer periphery of the lower end of the cap is swaged to the neck portion 11*c* so as to be firmly fixed, while being plastically deformed and compressing the seal member 26. In addition, the fixing structure of the cover cap 22 and the container body is not particularly limited.

In the valve mechanism 21 as described above, when the stem 24 is pushed down, the upper storage portion 14 is opened to the exterior through the first passage, the lower storage portion 15 is opened to the exterior through the second passage. Hence, the piston 12 is pushed by the pressurizing agent 20 to move upward. Thereby the main body portion 12*b* of the piston moves upward within the first storage portion 14, and pushes out the first content 18. Simultaneously, the flange portion 12*c* of the piston moves upward to push out the second content 19 from the lower storage portion 15. In addition, FIG. 2 shows a state where the piston 12 moves to the upper end, discharging the whole amount of the first content 18 and the second content 19. In this embodiment, since the upper storage portion 14 and the lower storage portion 15 are pressurized with the one piston 12 by the pressure of the same pressurizing agent 20, the amount of the first content 18 and the second content 19 pushed out from the upper storage portion 14 and the lower storage portion 15 is proportional to the cross-sectional area of the upper storage portion 14 and the lower storage portion 15. In addition, the piston 12 may be made so that the main body portion 12*b* and the flange portion 12*c* are made to be a separate member, and that in which the body portion 12*b* and the flange portion 12*c* are integrated may be used. As described in FIG. 1, the inside of the housing 23 is partitioned by the second stem rubber 29*b*. In other words, the first passage and the second passage in the valve mechanism 21 are independent. Hence, the first content 18 and the second content 19 are not mixed until being discharged outside, and after discharged outside, those can be mixed. However, the first passage and the second passage in the valve mechanism 21 can be joined together along the way, mixing the two contents in mid-stream.

The cross-sectional area of the stem hole 28*a*, 28*b*, the communication hole 30*a*, 30*b* of the valve is preferable to be made as large as 1-10 $mm^2$. By making this as just described, since the first content 18 and the second content 19 pushed out by the piston 12 are hard to be constrained in its flow volume by the stem holes 28*a*, 28*b* and the communication holes 30*a*, 30*b*, the discharge amount can be adjusted by the cross-sectional area ratio of the first storage portion 14 and the second storage portion 15 (the outer periphery diameter r, R). Stated differently, even if being the contents having viscosity difference, it is possible to discharge at a constant ratio or at an equal amount without the discharge ratio being broken.

In this embodiment, the flange portion 12*c* of the piston inclines downward, but it may be that which is straight in the radial direction, in this case, the diameter-expanded step portion 11*e* of the container body may be made straight in the radial direction.

Moreover, it may be so that the tube 17 is that which can be elastically deformed and, when the piston moves upward, is curved in the upper storage portion 14 without being housed in the center hole 12*a* of the piston.

Figure 3:
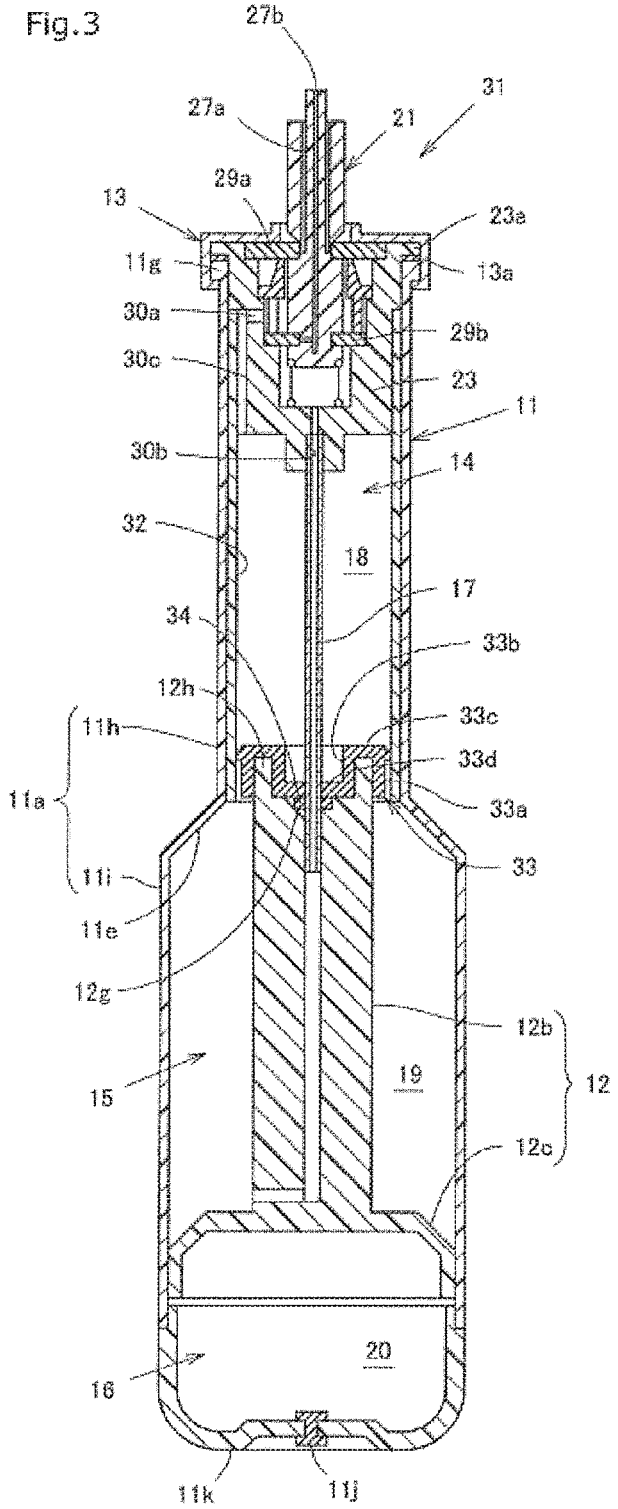
FIG. 3 is a cross-sectional view showing another embodiment of the two-liquid discharge container of the piston coaxial type of the present invention.

Further, the container body 11 may be formed of synthetic resin (for example, FIG. 3, 4). As the synthetic resin to become the material thereof, that which is not erodible by filled contents, for example, polyethylene terephthalate, polycyclohexanedimethylene terephthalate, polyarylate, nylon, cyclicolefin copolymer etc. of thermoplastic resin, can be adopted, and is formed by biaxially oriented stretch blow molding etc. For example, a parison formed by injection molding, extrusion molding etc. is heated, and inflated in a metal mold while being stretched in the axial direction, and formed into a desired shape. The neck portion 11*c* and the mouth portion 11*d* (in FIG. 3, 4, a thick-walled flange 11*g*) is in common with the parison normally, and is thick-walled because it is not inflated. As the synthetic resin, that which having translucency may be used to give translucency to the container body 11. In this case, the remaining quantity, the state etc. of the content can be visually observed.

Moreover, a coating material such as carbon, alumina, silica etc. can be provided on the inside or outside surface of the container 11 in order to protect the content from ultraviolet lays.

The first content 18 and the second content 19 filled in the upper storage portion 14 and the lower storage portion 15 are those which are stored in a separated state each other, and are mixed when used. For example, that in which the first agent of a hair dye of an oxidative hair-dyeing agent containing dyes such as paraphenylenediamine is made to be the first content 18, the second agent of the oxidative hair-dyeing agent containing hydrogen peroxide which oxidizes the dyes is made to be the second content 19, and hair dye effect is applied by mixing the both, or that in which an exothermic agent of non-aqueous containing inorganic salt such as magnesium chloride is made to be the first content 18, an agent containing water reactive with the inorganic salt is made to be the second content 19, thermal comfort effect is applied by mixing the both can be cited. Moreover, an urethane foam etc. formed by foam formation by a generated gas which is generated by condensing and polymerizing isocyanate and hydroxyl of polyalcohol with water, and by a foaming agent can be cited.

Further, that which becomes a gel (being not limited in application, such as hair setting agent, anti-inflammatory analgesic, medicine for hot flash) where the first content 18 containing a water-soluble macromolecule thickening in an alkaline region such as calbxyvinylpolymer and the second content 19 containing alkali agent which neutralizes the water-soluble macromolecule are combined and mixed to be neutralized and thickened, and that in which two liquids react such as a cream and a foam by which a sense of warmth can be gotten, where the first content 18 containing a polyalcohol such as glycerin, ethylene glycol and the second content 19 containing a small amount of water which hydrates with the polyalcohol are combined and mixed to generate heat by hydration can be cited, or two contents which are used in series such as a shampoo and a rinse, a cleansing cream and a skin care cream can be cited.

In a pressurizing agent housing portion 16, the pressurizing agent 20 consisting of a compressed gas such as nitrogen, carbon dioxide, air, and a liquefied gas such as liquefied petroleum gas, dimethyl ether, hydrofluoroolefin are filled. Particularly, it is preferable to be made into a compressed gas.

As a method to fill the pressurizing agent 20, the content 18, 19 into the two-fluid discharge container 10, first, the piston 12 is inserted into the body portion 11*a* of the container body, and the bottom lid 11*k* is firmly fixed, the valve assembly 13 is firmly fixed to the mouth portion 11*d* of the container body to close the discharge container. Then, into the pressurizing agent housing portion 16 of the container body 11, the pressurizing agent 20 is filled from the valve 11*j* of the bottom portion 11*k*, the stem 24 is pushed down to exhaust air within the upper storage portion 14 and the lower storage portion 15 to make the piston 12 move upward. Then, from the first intra-stem passage 27*a* and the second intra-stem passage 27*b* of the stem 24, the first content 18 and the second content 19 are filled into the upper storage portion 14 and the lower storage portion 15 respectively. In addition, when the valve 11*j* is not provided, the piston 12 is inserted to the body portion 11*a* of the container body, and the pressurizing agent 20 is filled just before the bottom lid 11*k* is firmly fixed. After that the contents are filled exhausting air similarly.

FIG. 3 shows another embodiment of the two-fluid discharge container of the present invention. It is the two-fluid discharge container in which the two storage portions are deviated vertically. This two-fluid discharge container 31 is also that in which, same as the two-fluid discharge container 10 of FIG. 1, the piston 12 partitions the space into three coaxial spaces in series from the top so as to be the columnar upper storage portion 14, the cylindrical lower storage portion 15, and the columnar pressurizing agent housing portion 16, having similar effects. In addition, the two-fluid discharge container 31 of FIG. 3 is that in which the chemical resistant property of the upper storage portion 14 is enhanced than that of the two-fluid discharge container 10 of FIG. 1, and in which in the inner surface of the thin body portion 11*h* of the container body 11, a sliding layer 32 composed of a material whose chemical resistant property is high is provided, and in the tip of the piston 12, a tip member 33 composed of a material whose chemical resistant property is high is provided in the tip of the piston 12.

The container body 11 is a pressure resistant container made of synthetic resin, provided with the cylindrical body portion 11*a* and the diameter-expanded thick flange 11*g* above the body portion. Different to FIG. 1, it does not have the shoulder portion, neck portion, and diameter-expanded mouth portion. In the lower end of the body portion 11*a*, the bottom lid 11*k* equipped with the valve 11*j* for filling the pressurizing agent is engaged, and is welded in the center portion. The body portion 11*a* presents a two-stage step consisting of the upper thin body portion 11*h*, and the lower thick body portion 11*i* from the center wholly, and between the both, the (diameter-expanded) step portion 11*e* is provided. Moreover, the seal between the body portion 11 and the valve assembly 13 is formed by the annular seal member 13*a* provided between the thick flange 11*g* and the upper end flange 23*a* of the housing 23 of the valve assembly 13.

The sliding layer 32 is provided so as to cover the inner surface of the thin body portion 11*h* of the container body 11. In addition, in the inner surface of the sliding layer 32, the housing 23 of the valve mechanism 21 is fitted. In the outer periphery of the housing 23 of the valve mechanism 21, a slit 30*c* is formed toward the lower end from the upper communication hole 30*a*. This slit 30*c* makes communication between the upper storage portion 14 and the housing 23. The first passage communicating with the first storage portion 14 of the valve mechanism 21 reaches the gap (slit 30*c*) through the upper space of the housing 23, and the upper communication hole 30*a* from the first intra-stem passage 27*a*. The second passage communicating with the second storage portion 15 reaches the tube 17 through the lower space of the housing 23 and the lower communication hole 30*b* of the lower end of the housing 23 from the second intra-stem passage 27*b*. Another composition of the valve mechanism 21 is substantially same as the valve mechanism 21 of FIG. 1.

The piston 12 is a convex body consisting of the columnar main body portion 12*b* and a flange portion 12*c* formed in the lower end periphery of a the main body portion 12*b*. And, in the tip of the main body portion 12*b*, a tip member 33 is provided. This piston 12 is configured so that the tip member 33 acting as a part of the main body portion 12*b* slides in the sliding member 32. Stated differently, the outer diameter of the main body portion 12*b* is configured so as to be smaller than the inner diameter of the sliding layer 32. However, it may be the same diameter so as to slide on the main body portion 12*b*. Moreover, in the upper end surface of the main body portion 12*b*, a seal holding portion 12*g* on which a seal member 34 which seals in between the tube 17 is held is formed. The upper end of the main body portion 12*b* is made to be an engaging portion 12*h* protruding annularly.

The tip member 33 is a cylindrical body having the shape of approximate M letter in cross section consisting of an external tube 33*a*, an internal tube 33*b*, a connecting ring 33*c* which connects the external tube 33*a* and the upper end of the internal tube 33*b*, and a bottom portion 33*d* in which a center hole is formed closing the lower end of the internal tube 33*b*. An engaging portion 12*h* of the main body portion is fitted between the external tube 33*a* and the internal tube 33*b* of the tip member 33, connecting the tip member 33 and the main body portion 12*b*. Moreover, it is configured so that the lower end of the housing 23 can engage with the inside of the internal tube 33*b*.

In addition, the fixing structure and engaging structure of the tip member 33 and the main body 12*b* are not particularly limited.

This two-fluid discharge container 31 can be made so as to be a two-fluid discharge container whose durability is high and can store the content for a long period by selecting the material quality of the container body 11, the sliding layer 32, the tip member 33 of the piston 12, and the main body portion 12*a* of the piston 12. Particularly, in this two-fluid discharge container 31, when the sliding layer 32 composing the inner surface of the upper storage portion (the first storage portion) 14 is formed from alkali resistant synthetic resin such as polyethylene, nylon etc. or glass, and the tip member 33 is formed from an elastic body of polyolefin elastomer such as silicon rubber, fluororubber, polyethylene, and polyamide elastomer such as nylon, urethane elastomer, the container body 11 composing the lower storage portion (the second storage portion) 15, and the body portion 12*a* of the piston are formed from acid resistant synthetic resin of polyethylene terephthalate etc. or glass, even if an alkaline undiluted solution (two-liquid type hair dye first agent) is filled in the upper storage portion (the first storage portion) 14, and an acid undiluted solution (two-liquid type hair dye second agent) is filled in the lower storage portion (the second storage portion) 15, the both undiluted solution can be stored stably for a long period. Moreover, it may be that the inner surface of the upper storage portion 14 is composed of an acid resistant material, the inner surface of the lower storage portion 15 is composed of an alkali resistant material, and an acid undiluted solution is filled in the upper storage portion 14, an alkaline undiluted solution is filled in the lower storage portion 15.

Figure 4:
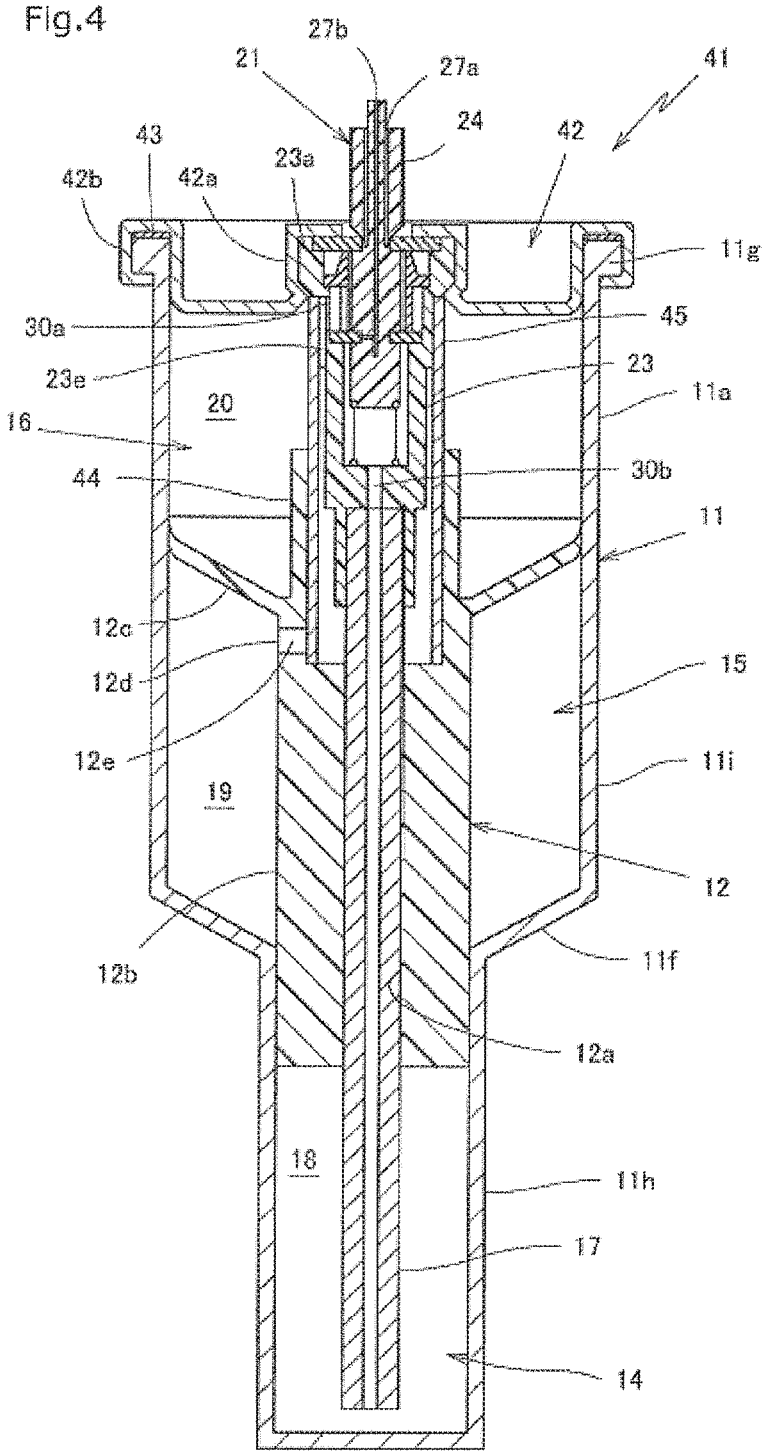
FIG. 4 is a cross-sectional view showing further another embodiment of the two-liquid discharge container of the piston coaxial type of the present invention.

FIG. 4 shows another embodiment of the two-fluid discharge container of the present invention. This two-fluid discharge container 41 is that in which the piston 12 of the two-fluid discharge container 10 of FIG. 1 is turned upside down. Stated differently, in the container body 11, the flange portion 12*c* of the piston is made above, the main body portion 12*b* is made below, and the tip of the main body portion 12*b* faces downward. And, the main body portion 12*b* of the piston 12 is provided so as to penetrate the thick body portion 11*i* of the container body 11. Accordingly, the pressurizing agent storage portion 16 in which the pressurizing agent 20 is filled is provided in the upper space of the container 11, the second storage portion 15 in the side of the piston 12 which is a middle space, the first storage portion 14 in the lower space of the piston 12 respectively.

This container body 11 is that which is formed of synthetic resin such as polyethylene-terephthalate, where a diameter-reduced step portion 11*f* diameter-reduced facing obliquely downward is formed in the vicinity of medium of the body portion 11*a*. Hence, it presents the shape of a thin two stage step, being thick in the upper portion, being thin in the lower portion of the body portion bordered by the diameter-reduced step portion 11*f*. Moreover, in the upper end of the body portion 11*a*, a flange 11*g* is provided, not having the shoulder portion, neck portion and diameter-expanded portion as shown in FIG. 1. Hence, the first storage portion 14 is inside of the thin body portion 11*h*, being a columnar space surrounded by the tip surface (the lower end face of FIG. 4) of the main body portion 12*b* and the bottom portion of the container body 11. And, the second storage portion 15 is inside of the thick body portion 11*i*, and is a cylindrical space surrounded by the upper surface of the diameter-reduced step portion 11*f*, the outer periphery surface of the main body portion 12*b*, and the lower surface of the flange portion 12*c* of the piston 12. The pressurizing agent housing portion 16 is inside of the thick body portion 11*i*, and is a columnar space surrounded by the upper surface of the flange portion 12*c* of the piston 12, the outer periphery surface of the main body portion 12*b*, and the valve assembly 13 (a mounting cap 42 described later). These three spaces are also provided coaxially with the center axis of the container body 11 same as the two-fluid discharge container body 10 of FIG. 1, and in the top view, constitutes the circular first storage portion 14 being in the center, and the ring like second storage portion 15 provided in the outer periphery thereof. Further, the first storage portion 14 and the second storage portion 15 adjoin substantially. And, each cross sectional area of the first storage portion 14 and the second storage portion 15 is made to be the same so as to discharge the same amount of the content.

Further, in this two-fluid discharge container 41, the valve mechanism 21 is directly held by a mounting cap 42. In other words, the valve assembly 13 acting as a lid portion consists of the mounting cap 42 and the valve mechanism 21. The mounting cap 42 is provided with a tubular valve holding portion 42*a* which covers the upper end opening portion of the housing 23, and sandwiches the upper end flange 23*a* of the housing 23, and a fitting-in portion 42*b* which is connected with the lower end of the valve holding portion 42*a* and engages with the flange portion 11*g* of the upper end of the container body 11 so as to cover it through the seal member 43.

Further, in the lower surface of the upper end flange 23*a* of the valve mechanism, an outer tube 45 for communicating with the second storage portion 15 is provided so as to communicate with the upper communicating hole 30*a*. This outer tube 45 extends lower than the lower end of the housing 23 leaving a space to become the passage of the second content 19 in between the housing 23. Here, the lower portion of the upper communicating hole 30*b* of the housing is cut out (the reference numeral 23*e*). Moreover, a tubular pipe 44 extending upward from the upper end of the piston 12 is provided, so as to be freely slidable on the outer tube 45, and to be liquid-tight. The center hole 12*a* of the piston penetrates the main body portion 12*b* of the piston 12, and the tube 17 is inserted therein. By this tube 17, the first storage portion 14 and the housing 23 are communicated. Moreover, in the upper end outer periphery (the lower side of the flange 12*c*) of the main body portion 12*b* of the piston 12, a hole 12*d* and a lateral passage 12*e* led into the hole 12*d* is provided, and the second storage portion 15 and the inside of the pipe 44 are communicated. In this valve mechanism 21, the first passages and the second passage are inverted to that of the valve mechanism 21 of FIG. 1. Stated differently, the first passage of the valve mechanism 21 reaches the tube 17 through the lower space of the housing 23, the lower communication hole 30*b* of lower end the housing 23 from the second intra-stem passage 27*b*. The second passage of the valve mechanism 21 reaches the upper communicating hole 30*a* formed in the side wall of the housing 23 and communicated with the second storage portion 15, and the outer tube 45 (in detail, between the outer tube 45 and the housing 23, and between the outer tube 45 and the tube 17) through the upper space of the housing 23 from the first intra-stem passage 27*a*.

Figure 5:
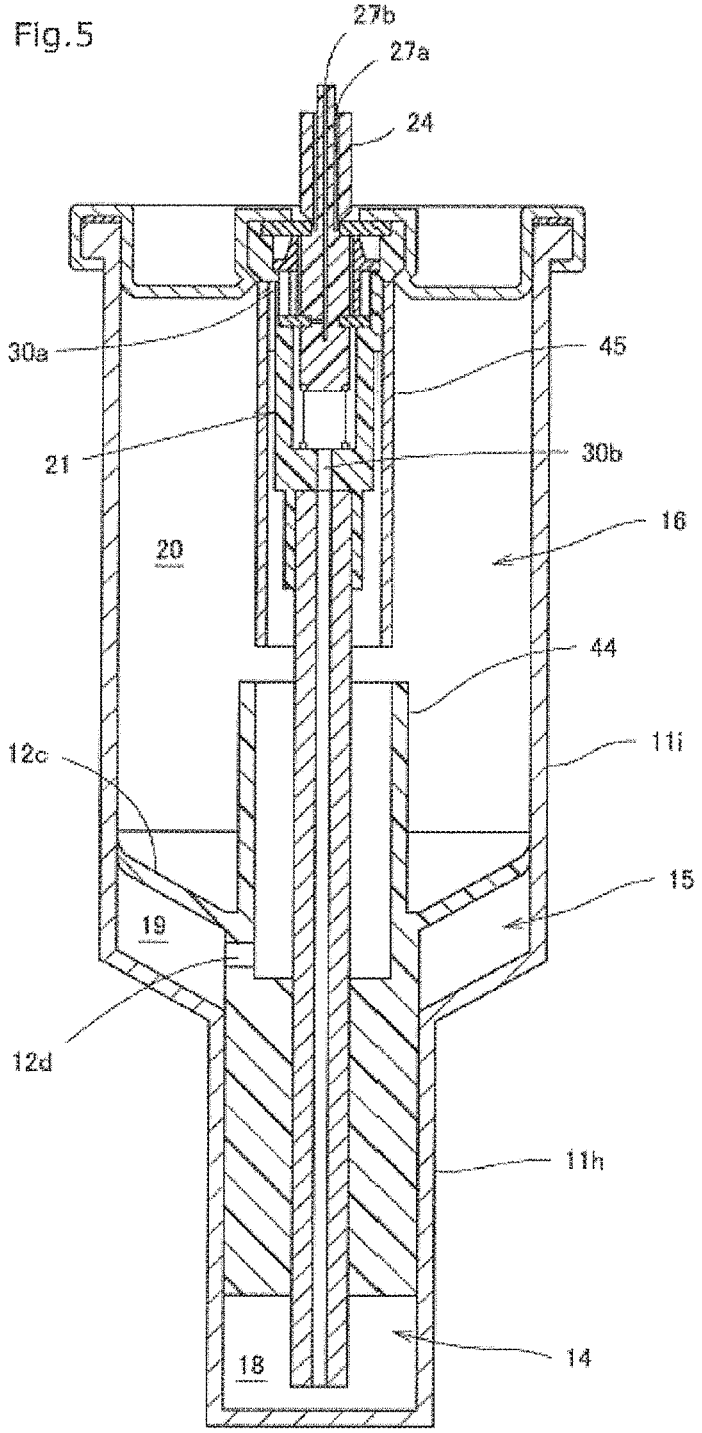
FIG. 5 is a cross-sectional view showing the operated state of the two-liquid discharge container of FIG. 4.

In the valve mechanism 21 constituted as described above, when the stem 24 is pushed down, the second storage portion 15 is communicated with the exterior through the second passage, the first storage portion 14 is communicated with the exterior through the first passage. Hence, when the stem 24 is pushed down, the piston 12 is pushed to move downward by the pressurizing agent 20. Thereby, the flange portion 12*c* of the piston moves downward, and pushes out the second content 19 into inside of the pipe 44 through the hole 12*d* of the outer periphery of the piston from the second storage portion 15. This second content 19 is pushed into the upper communicating hole 30*a* passing through the gap (cutout 23*e*) between the outer tube 45 and the housing 23. Meanwhile, the main body portion 12*b* of the piston moves downward within the first storage portion 14, and pushes out the first content 18 to the lower communicating hole 30*b* of the lower end of the housing through the tube 17. After that, each content 18, 19 is discharged from the stem 24 separately by the similar mechanism as the container 10 described in FIG. 1. In this embodiment, just after the content is filled, since the lower end of the outer tube 45 closes the hole 12*d* by contacting the lower end of the pipe 44 of the piston (refer to FIG. 4), it is possible to fill non-reactive component such as nitrogen gas in the outer tube 45 and the first passage of the valve mechanism 21, making it possible to store the content stably. Moreover, when almost of the content is discharged and the piston 12 reaches the lower end, the upper end of the pipe 44 disengages from the lower end of the outer tube 45 to exhaust the pressurizing agent 20 (refer to FIG. 5). Since the pressurizing agent 20 can be exhausted after use, the disposal of the container is easy.

As the method to fill the pressurizing agent 20, the content 18, 19 in the above two-fluid discharge container 41, first, the first content 18 is filled in the first storage portion 14, the piston 12 is inserted into the container body 11. Then, the second content 19 is filled in the second storage portion 15 through the hole 12*d* from the pipe 44. The tube 17 is inserted into the center hole 12*a* of the piston, and the valve assembly 13 is put on the opening of the container body 11. After that, by an undercup filling method, the pressurizing agent 20 is filled in the pressurizing agent housing portion 16, and the valve assembly 13 is firmly fixed.

Figure 6:
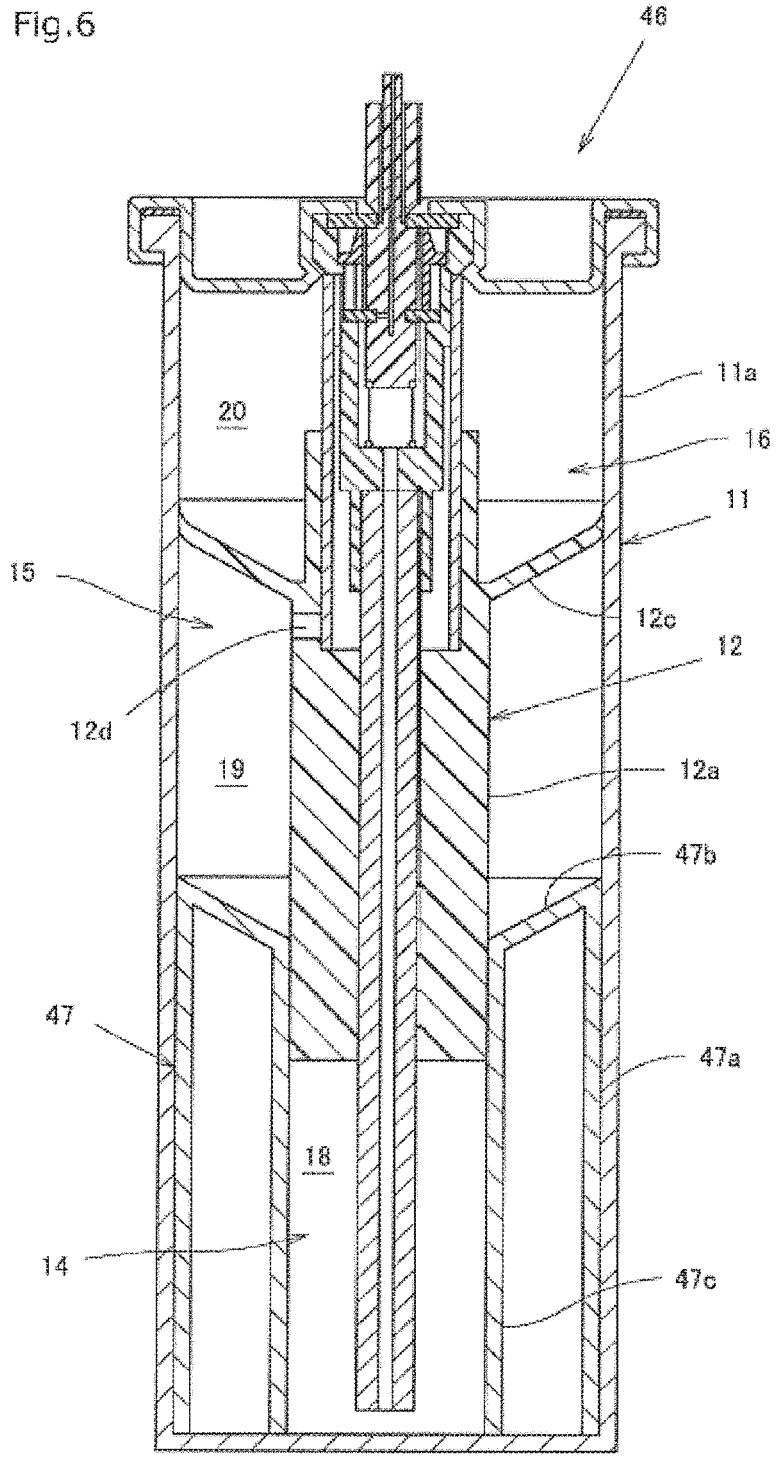
FIG. 6 is a cross-sectional view showing further another embodiment of the two-liquid discharge container of the piston coaxial type of the present invention.

FIG. 6 shows another embodiment of the two-fluid discharge container of the present invention. This two-fluid discharge container 46 is that in which a spacer 47 is arranged in place of the thin body portion in the body portion 11*a*. The spacer 47 consists of a tubular outer plate 47*a* which tightly engages with the inner periphery surface of the body portion 11*a*, a step portion 47*b* inclining obliquely downward and inward in the radial direction from the upper end, and a tubular inner plate 47*c* hanging down from the inner end of the step portion 47*b*. In other words, the inner surface of the inner plate 47*c* acts as the thin body portion substantially, the inner space of the inner plate 47*c* is made to be the first storage portion 14 in which the main body portion 12*b* of the piston slides. The lower end of the inner plate 47*c* may be closed by the bottom surface. Moreover, the step portion 47*b* forms the second storage portion 15 together with the outer periphery surface of the piston 12, the lower surface of the flange portion 12*c*, and the inner surface of the body portion 11*a*. Since the body portion 11*a* of this discharge container 46 is cylindrical, it is easy to assemble. Such spacer 47 can be adopted in the two-fluid discharge container 10 of FIG. 1.

Figure 7:
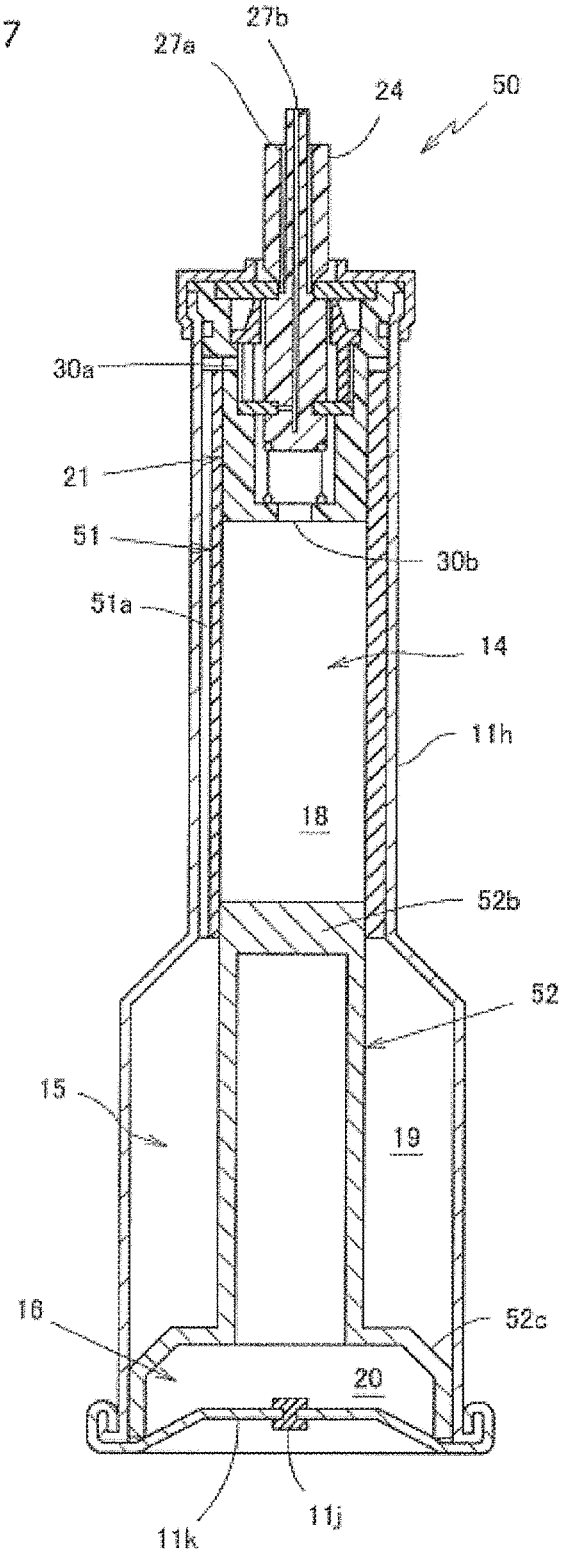
FIG. 7 is a cross-sectional view showing further another embodiment of the two-liquid discharge container of the piston coaxial type of the present invention.

FIG. 7 shows another embodiment of the two-fluid discharge container of the present invention. This two-fluid discharge container 50 is not equipped with the tube 17, and in place thereof, a tubular sliding layer 51 in which the passage of the second content 19 communicating the housing 23 and the second storage portion 15 is arranged in the outer periphery in the thin body portion 11*h* of the container body 11. The outer periphery of the sliding layer 51 contacts tightly to the inner periphery of the thin body portion 11*h*, the inner periphery is made to be the sliding surface on which the main body portion 52*b* of the later described piston 52 slides, and constitutes the inner surface of the first storage portion 14 in between the tip of the piston 52. In other words, the inner surface of the sliding layer 51 acts as the inner surface of the thin body portion substantially. In addition, in the outer periphery of the sliding layer 51, a slit 51*a* serving as the passage of the second content 19 is formed. In detail, between this slit 15*a* and the inner periphery of the thin body portion 11*h* serves as the passage of the second content 19. The slit 51*a* is formed in the vertical direction (in the axial direction), and reaches up to the upper surface side and the lower surface side of the cylinder 51. The lower end side of the slit communicates with the upper side of the second storage portion 15, the upper end communicates with the upper communicating hole 30*a*. Meanwhile, the first storage portion 14 communicates with the lower communicating hole 30*b*.

Stated differently, the first passage communicating with the first storage portion 14 of the valve mechanism 21 reaches the lower space of the housing 23 and the lower communicating hole 30*b* of the lower end of the housing 23 from the second intra-stem passage 27*b*. Meanwhile, the second passage communicating with the second storage portion 15 reaches the upper communicating hole 30*a* and the slit 51*a* through the upper space of the housing 23 from the first intra-stem passage 27*a*.

The piston 52 is a convex body equipped with a tubular main body portion 52*b* having a pressing surface in the tip thereof, and a flange portion 52*c* provided in the outer periphery of the base of the main body portion, not being equipped with a center hole. The pressing surface acts as the first piston portion 12*b* which pressurizes the first content 18 in the first storage portion 14, the flange portion 52*c* acts as the second piston portion pressurizing the second content 19 in the second storage portion 15. The inside of the piston 52 is hollow, and this inside space constitutes a part of the pressurizing agent storage portion. Hence, as shown in FIG. 7, even if the first content 18 and the second content 19 are filled in each storage portion at their maximum amount, and the piston 52 is in the position contacting the bottom lid 11*k*, since the space inside of the piston can be made as the pressurizing agent storage portion 16, the inside space of the container body 11 can be utilized without waste, the discharge container can be made compact.

As the method for filling the pressurizing agent 20, the content 18, 19 in the two-fluid discharge container 50, same as the two-fluid discharge container 10 of FIG. 1, the piston 52 is inserted into the body portion 11*a* of the container body, the bottom lid 11*k* is firmly fixed, and the valve assembly 13 to which the sliding layer 51 is attached is firmly fixed to the mouth portion 11*d* of the container body to close the discharge container. Then, the pressurizing agent 20 is filled in the pressurizing agent housing portion 16 of the container body 11 from the valve 11*j* of the bottom lid 11*k*, and the stem 24 is pushed down to exhaust air in the first storage portion 14 and the second storage portion 15, making the piston 52 move upward. Then, from the first intra-stem passage 27*a* and the second intra-stem passage 27*b* of the stem 24, the first content 18 and the second content 19 are filled in the first storage portion 14 and the second storage portion 15 respectively. In addition, in the case that the valve 11*j* is not provided, the pressuring agent 20 is filled when the bottom lid 11*k* is firmly fixed.

In this embodiment, when the stem 24 is pushed down, the main body portion 52*b* of the piston moves upward in the sliding layer 51 by the pressure of the pressurizing agent 20. Hence, the first content 18 is discharged outside through the second intra-stem passage 27*b* from the lower communicating hole 30*b* of the valve mechanism 22 (the first passage). At the same time, the flange portion 52*c* of the piston moves upward in the thick body portion 11. Hence the second content 19 is discharged outside through the first intra-stem passage 27*a* from a slit 51*a* of the sliding layer and the upper communicating hole 30*a* (second passage).

Figure 8:
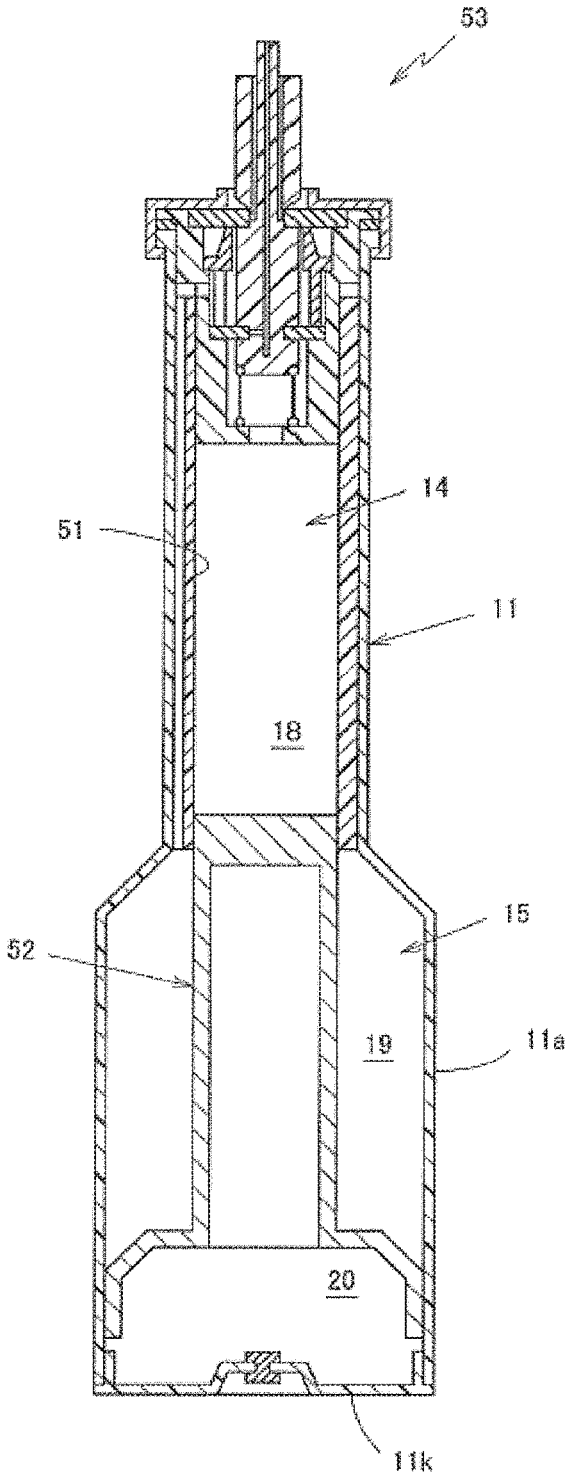
FIG. 8 is a cross-sectional view showing further another embodiment of the two-liquid discharge container of the piston coaxial type of the present invention.

The two-fluid discharge container 53 of FIG. 8 adopts the container body made of synthetic resin same as the two-fluid discharge container of FIG. 3, the bottom lid 11*k* of the container body 11 being welded to the body portion 11*a* so as to be fixed. Another composition is substantially same as the two-fluid discharge container 50 of FIG. 7. In addition, in the two-fluid discharge container 53, a part of the upper storage portion 14 and/or the lower storage portion 15 is made of glass. For example, by forming the piston 52 partitioning the upper storage portion 14 and the second storage portion 15 from glass, even if an acid undiluted solution and/or an alkali undiluted solution is filled in the upper storage portion 14 and the second storage portion 15, the deterioration of the piston 52 can be prevented. Further, by selecting a proper material according to the contents for the container body 11 and the sliding layer 51 other than the piston 52, it becomes the two-fluid discharge container having high durability. Particularly, when the piston is formed from glass, the container body is formed of acid resistant synthetic resin such as polyethylene terephthalate, the cylinder 51 is formed of alkali resistant synthetic resin such as polyethylene, nylon, even if an alkali undiluted solution (two-fluid type hair dye first agent) is filled in the upper storage portion (the first storage portion) 14, and an acid undiluted solution (two-fluid type hair dye second agent) is filled in the lower storage portion (the second storage portion) 15, the both undiluted solutions can be stored stably. Meanwhile, the sliding layer 51 may be formed from glass, In this case, by forming the container body from acid resistant synthetic resin such as polyethylene terephthalate, and by forming the piston from alkali resistant synthetic resin such as polyethylene, nylon, even if an alkali undiluted solution (two-fluid type hair dye first agent) is filled in the upper storage portion (the first storage portion) 14, and an acid undiluted solution (two-fluid type hair dye second agent) is filled in the lower storage portion (the second storage portion) 15, the both undiluted solutions can be stored stably. Further, both the sliding layer 51 and the piston 52 may be formed from glass.

Figure 9:
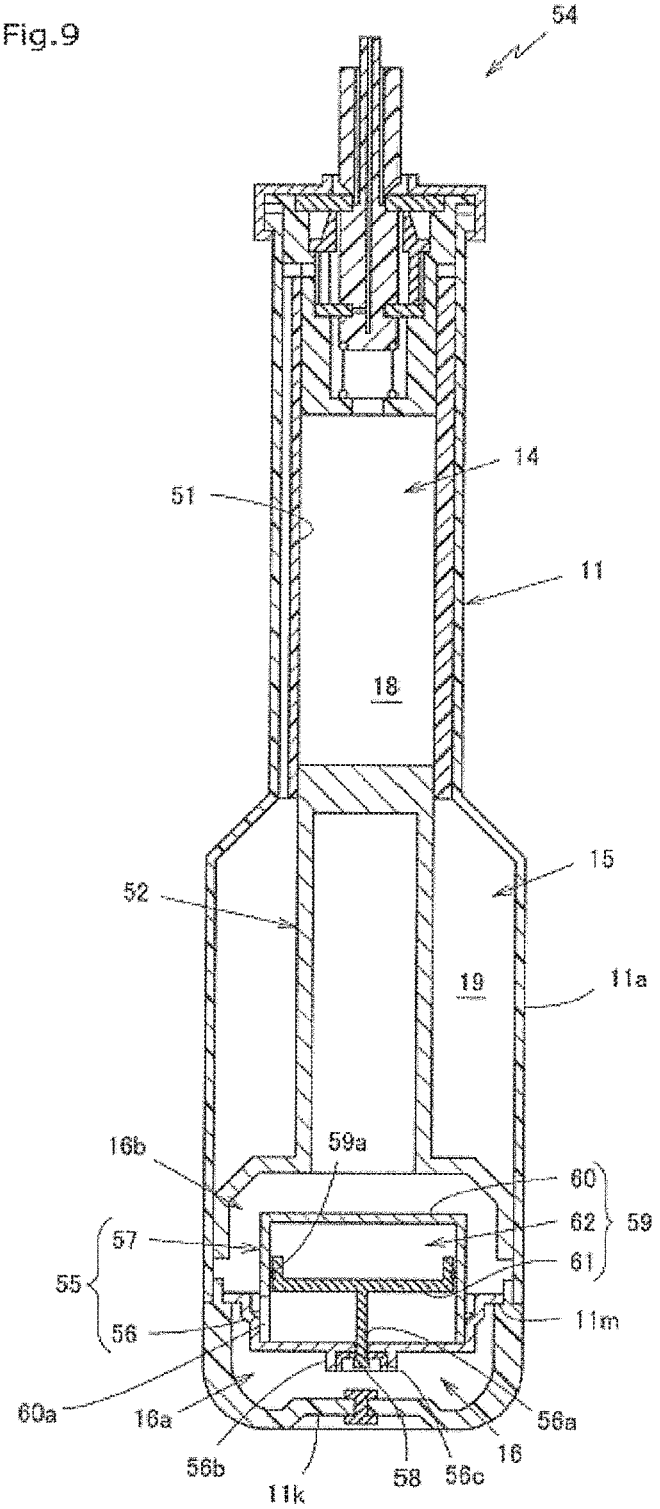
FIG. 9 is a cross-sectional view showing further another embodiment of the two-liquid discharge container of the piston coaxial type of the present invention.

The two-fluid discharge container 54 of FIG. 9 is that in which the piston 52 can be pressurized by an equal pressure regardless of the cubic volume of the pressurizing portion 16, making the discharge amount per unit time of the content equal until last. In detail, in the pressurizing agent housing portion 16 of the two-fluid discharge container 53 of FIG. 8, a regulating mechanism 55 for pressing the piston by an identical pressure always is provided. In detail, an engaging step portion 11*m* is provided in the opening portion of the lid bottom 11*k*. And, the regulating mechanism 55 is mounted on the engaging step portion 11*m*.

The regulating mechanism 55 is engagingly stopped on the engaging step portion 11*m*, and consists of a partitioning plate 56 which partitions the pressurizing agent housing portion 16 into top and bottom two spaces (a high pressure chamber 16*a* and a low pressure chamber 16*b*), and a regulation valve 57 provided in the center hole 56*a* of the partitioning plate 56. In the center of the lower surface of the partitioning plate 56, a tubular portion 56*b* protruding downward is provided so as to communicate with the center hole 56*a*, and in the tubular portion 56*b*, an annular seal member 56*c* is provided. The regulation valve 57 introduces a compressed gas from the high pressure chamber 16*a*, when the pressure of the low pressure chamber 16*b* becomes lower than a constant pressure, in order to control the pressure of the low pressure chamber 16*b* to be a constant pressure always. In detail, this valve consists of the center hole 56*a* of the partitioning plate 56, a plug body 58 which closes the center hole 56*a* from below, a pressing mechanism 59 which presses the plug body 58 in the direction to open (downward) the center hole 56*a* when the pressure of the low pressure chamber 16*b* becomes lower than a constant pressure. The pressing mechanism 59 consists of a box body 60 whose upper bottom is tubular and in the lower portion of which a slit 60*a* communicating with the lower pressure chamber 16*b* is provided, a dish 61 connected with the plug body 58, moving vertically tightly in the inside thereof, and a pressure regulating chamber 62 sealed between the box body 60 and the dish 61. In addition, an annular seal member 59*a* is provided between the box body 60 and the dish 61. The regulation valve 57 composed as described above operates when the inner pressure of the low pressure chamber 16*b* becomes lower than the inner pressure of the pressure regulating chamber 62. Stated differently, the inner pressure of the low pressure chamber 16*b* becomes lower than that of the pressure regulating chamber 62, the dish 61 moves downward and the plug body 58 connected thereto opens the center hole 56*a*. In addition, in the box body 60, a compressed gas may be filled, or a spring may be installed, or the both may be provided.

Hence, when the two-fluid discharge container 54 is opened by operating the stem 24 of the two-fluid discharge container 54, the piston 52 moves upward by the pressure of the low pressure chamber 16*b* to discharge the content. At this moment, the volume of the low pressure chamber 16*b* (pressurizing agent housing portion 16) increases by the movement of the piston 52, and the pressure in the low pressure chamber 16*b* decreases in conjunction therewith. However, if the pressure of the low pressure chamber 16*b* becomes lower than a constant pressure, the pressure regulating chamber 62 pushes the dish 61 downward, and the plug body 58 opens the center hole 56*a*. Then, a compressed gas is introduced into the low pressure chamber 16*b* from the high pressure chamber 16*a* through the opened center hole 56*a*. After that, when the inner pressure of the low pressure chamber 16*b* becomes somewhat higher than the inner pressure of the pressure regulating chamber 62, the dish 61 is pushed upward, making the plug body 58 close again the center hole 56*a*. As described above, since the low pressure chamber 16*b* pressing the piston is maintained at a constant pressure (somewhat higher than the inner pressure of the pressure regulating chamber 62), it is possible to keep the discharge amount per unit time to be constant until last.

Such regulating mechanism can be applied to any embodiment using the pressurizing agent as a pressurizing means.

Figure 10:
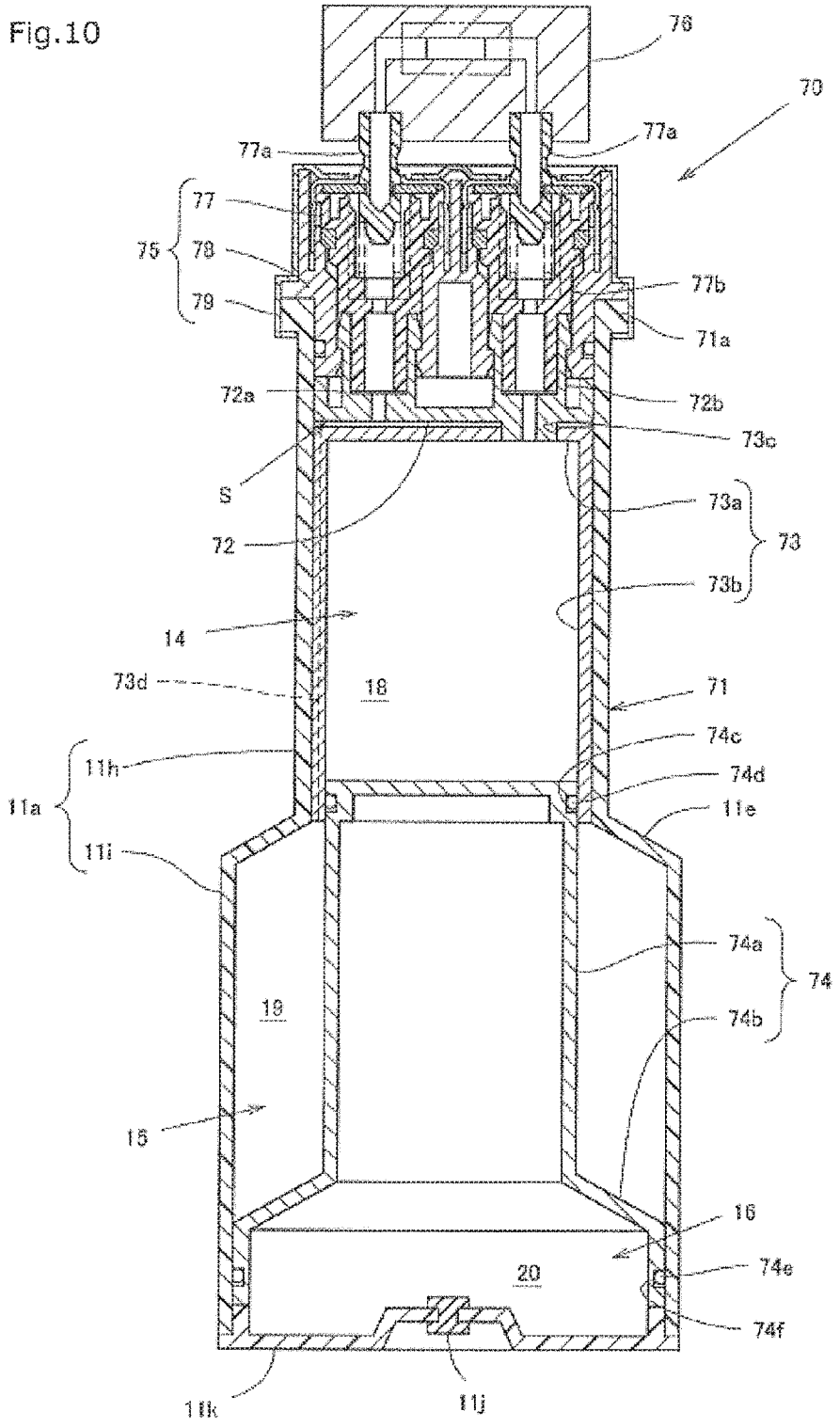
FIG. 10 is a cross-sectional view showing further another embodiment of the two-liquid discharge container of the piston coaxial type of the present invention.

The two-fluid discharge container 70 of FIG. 10 is an example of that in which the valve assembly is provided with two stems, the first storage portion 14 communicating with one side stem, and the second storage portion 15 communicating with the other stem. In detail, it is an aerosol container equipped with a container body 71, a partitioning wall 72 accommodated in the container body 71, partitioning the inside of the container 71 into the upper and lower two spaces of an assembly accommodating space and a content space storing a content, a tubular sliding layer 73 accommodated in the content storage portion below the partitioning wall 72, a piston 74 sliding on the inner surface of the container body 71 and the inner surface of the sliding layer 73, partitioning the content space lower than partition wall in the container body 71 into three spaces in the vertical direction, and a valve assembly 75 which closes the upper end opening of the container body 71 and performs the communication/shut off between the content space lower than the content space and the exterior. A push button 76 which pushes the two stems simultaneously is attached to the valve assembly 75.

The container body 71 is a pressure resistant container made of synthetic resin provided with the cylindrical body portion 11*a*, the bottom portion 11*k* closing the lower end thereof, and a flange 71*a* protruding outward in the radial direction formed in the upper end of the body portion. The body portion 11*a* is substantially same as the body portion 11*a* of the container body 11 of the two-fluid discharge container of FIG. 1, and consists of an upper thin body portion 11*h* and a lower thick body portion 11*i*, and a diameter expanded step portion 11*e* between those. The bottom portion 11*k* is firmly fixed to the inner surface of the body portion 11*a* so as to engage therewith, and is equipped with a valve 11*j* in the center for filling the pressurizing agent 20.

The partitioning wall 72 is that which is of a bottomed tubular shape, fitted air-tightly into the thin body portion 11*h* of the container body 71. In the bottom portion of the partitioning wall 72, a tubular first valve connecting portion 72*a* and a second valve connecting portion 72*b* which protrude upward from the bottom portion and penetrate the bottom portion vertically are formed in a position deviated from the center. The first valve connecting portion 72*a* protrudes downward also. The first valve connecting portion 72*a* and the second valve connecting portion 72*b* face each other sandwiching the center axis. The partitioning wall 72 is a guide which efficiently send the first content 18 sent from the upper storage portion 14 to one side aerosol valve 77 (left side in the FIG. 13) of the valve assembly 75 through the first valve connecting portion 72*a*, and send the second content 19 sent from the lower storage portion 15 to the other side aerosol valve 77 (right side in the FIG. 13) of the valve assembly 75 through the second valve connecting member 72*b*. The space between the partitioning wall 72 and the valve assembly 75 (the lower surface of a valve holder 77 later described) is preferable to be as small as possible.

The sliding layer 73 is a tubular body arranged along the inner surface of the thin body portion 11*h* of the container body 71. The material quality of the sliding layer 73 may be same as that of the container body 71, and may be formed of different material quality according to the contents, for example, may be formed of cyclic olefin copolymer and nylon etc. excellent in an alkali resistant property. In other words, the container body 71 and the sliding layer 73 present a two-layer structure. The sliding layer 73 consists of an upper bottom 73*a* and a tubular sliding layer body 73*b* extending downward from the side edge thereof. A through hole 73*c* into which the second valve connecting portion 72*b* is inserted penetrating the upper bottom 73*a* is formed in the position deviated from the center of the upper bottom 73*a*. In the outer periphery surface of the sliding layer 73*b*, a groove 73*d* extending toward the vertical direction is formed. The sliding layer 73 is arranged so that a passage S is formed between the upper bottom 73*a* and the partition wall 72, and that a second valve connecting portion 92*b* of the partition wall is inserted into the through hole 73*c*. The through hole 73*c* and the first valve connecting portion 72*a* are fitted air-tightly.

The piston 74 is a convex body provided with a tubular piston body 74*a* having a pressing surface in the tip thereof and a flange portion 74*b* provided in the outer periphery of the base of the piston main body 74*a*. The piston main body 74*a* slides on the inner surface of the sliding body 73*b* of the sliding layer 73. In the upper outer periphery of the piston main body 74*a*, an annular groove 74*c* is formed, and in the upper annular groove 74*c*, an O ring 74*d* is attached for sealing so as to prevent the first content 18 in the upper storage portion 14 from leaking out, when the piston 74 moves upward. The flange portion 74*b* slides on a thick body portion 11*i* below the container body 71. In the outer periphery of the flange portion 74*b* also, a lower annular groove 74*e* is formed, and in the lower annular groove 74*e*, an O ring 7*f* is attached for sealing so as to prevent the second content 19 in the lower storage portion 15 from leaking out, when the piston 74 moves upward.

The valve assembly 75 is that which provided with two aerosol 77 valves having one stem 77*a*. In detail, it consists of a valve holder 78 closing the container body 71, two aerosol valves 77 being inserted penetrating through the valve holder, and a cover 79 which firmly fixes the valve holder 78 and the two aerosol valves 77 to the container body 71. In the lower end of the two aerosol valves 77, the first valve connecting portion 72*a* and the second valve connecting portion 72*b* are connected respectively. The aerosol valve 77 is that which is publicly known, and is opened by pushing down the accommodated stems 77*a* energized in the upward direction by the housing 77*b* always, each communicating/shutting off the passage communicating the storage portion and the stem.

In the two-fluid discharge container 70 composed as described above, the inside of the sliding layer 73 serves as the upper storage portion (the first storage portion) 14 which stores the first content 18, the space between the piston main body 74*b* of the piston 74 and the container 71 serves as the lower storage portion (the second storage portion) 15 housing the second content 19, and the space lower than the piston 74 serves as the pressurizing agent housing portion (the pressurizing space) 16 which houses the pressurizing agent 20. Moreover, the upper storage portion 14 and the aerosol valve 77 of one side (right side in the FIG. 13) are communicated through the second valve connecting portion 72*b*, and the lower storage portion 15 and the other aerosol valve 77 (left side in the FIG. 13) are communicated thorough the second valve connecting portion 72*b*, the passage S between the upper bottom 73*a* of the cylinder 73 and partition wall 72, and the groove 73*d* of the outer periphery surface of the cylinder body 73*b*.

This two-fluid discharge container 70 discharges the first content 18 and the second content 19 simultaneously, by pushing down the two stems 77*a* simultaneously to open the both aerosol valves 77 with push button 76 etc. In other words, by opening the both aerosol valves 77, the pressurizing agent 20 in the pressurizing agent housing portion (pressurizing space) 16 pushes the piston 74 upward, the upward motion of the piston 74 makes the upper storage portion (the first storage portion) 14 and the lower storage portion (second storage portion) 15 contract. At the same time, the first content 18 is supplied to the aerosol valve 97 of one side through the first valve connecting portion 72*a*, and the second content 19 is supplied to the other aerosol valve 97 through the second valve connecting portion 72*b*. In addition, although there are two stems 77*a*, since the contraction of the first storage portion 14 and the second storage portion 15 is coordinated, if the stem 77*a* of one side only is operated, it does not work. Hence, if it is operated in the wrong way, the content of only one side is never discharged, and two contents are securely discharged at a predetermined ratio.

Figure 11:
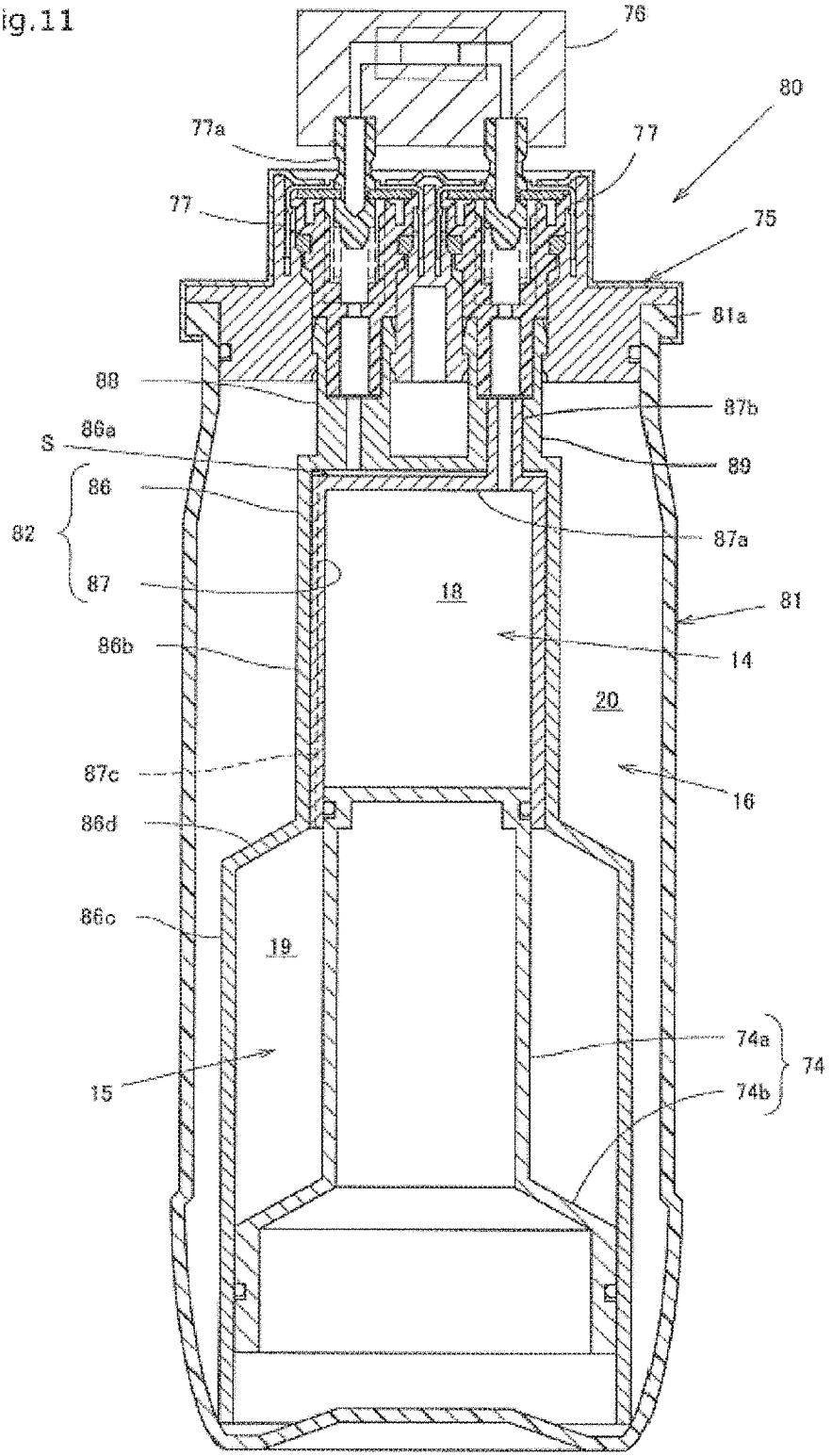
FIG. 11 is a cross-sectional view showing further another embodiment of the two-liquid discharge container of the piston coaxial type of the present invention.

The two-fluid discharge container 80 of FIG. 11 is that in which a cylinder member 82 constituting the first storage portion 14 and the second storage portion 15 is accommodated in the container body 81. In other words, the container 81 does not serve as a cylinder. Moreover, it is that which has two stems. In detail, it is an aerosol container equipped with a container body 81, the tubular cylinder member 82 accommodated in the container 81, the piston 74 which slides on the inner surface of the cylinder member, and partitions the space in the cylinder member 82 into two independent spaces of the first storage portion 14 and the second storage portion 15, and the valve assembly 75 which closes the upper end opening, and performs the communication/shut off between the space in the cylinder 82 and outside air. The piston 74 partitions the inside of the container 81 into a compressing space consisting of the first storage portion 14 and the second storage portion 15 in the cylinder member 82, and a space (pressurizing space 16)

between the container body 81 and the cylinder member 82. Stated differently, same as the discharge container of FIG. 1, it is partitioned into three spaces of the first storage portion 14, the second storage portion 15 and the pressurizing portion 16. The piston 74 and the valve assembly 75 is substantially same as the piston 74 and the valve assembly 75 of FIG. 13.

The container body 81 is a pressure resistant container provided with a bottom portion, a tubular body portion, a taper like shoulder portion, a cylindrical neck portion, and a thick flange portion 81*a* in the upper end thereof. The inner surface of the neck portion and the inner surface of a jaw portion are continuous, and are shaped to be a cylindrical shape composed of a vertical plane. This container body 81 is equipped with a straight body portion. The valve assembly 75 is firmly fixed to the thick flange portion 81*a*.

The cylinder member 82 consists of an outer cylinder 86 and an inner cylinder (sliding layer) 87 accommodated along the upper inner surface thereof. The outer cylinder 86 is equipped with an upper bottom 86*a*, a tubular thin cylinder body portion 86*b* extending downward from the side edge thereof, and a thick cylinder body portion 86*c* provided through a diameter expanded step portion 86*d* from below thereof. In the upper bottom 86*a*, a tubular first valve connecting portion 88 (left side of FIG. 14) and a second valve connecting portion 89 (right side of FIG. 14) protruding upward penetrating the upper bottom 86*a* vertically are formed in the position deviated from the center. And, in the second valve connecting portion 89, an insertion cylinder protruding upward from an inner cylinder 87 later described is inserted. The first valve connecting portion 88 and the second valve connecting portion 89 are connected to each aerosol valve 77.

The inner cylinder (sliding layer) 87 is a tubular body having an upper bottom 87*a* arranged along the inner surface of the thin cylinder body portion 86*b* of the outer cylinder. In the upper bottom 87*a* of the inner cylinder 87, an insertion cylinder 87*b* to be inserted into the second valve connecting portion 89 protruding upward in the position deviated from the center is formed. In the outer periphery surface of the inner cylinder 87, a groove 87*c* extending upward and downward is formed. The inner cylinder 87 is formed so that a passage S is formed between the upper bottom 87*a* and the upper bottom 86*a* of the outer cylinder 86. The insertion cylinder 87*b* and the second valve connecting portion 89 are fitted air-tightly.

Being constituted as described above, the main body 74*a* of the piston 74 slides on the inner surface of the inner cylinder 87, the flange portion 74*b* slides on the inner surface of the thick cylinder body 86*c* of the outer cylinder 86. And, the inside of the cylinder member 82 is partitioned into a first storage portion 14 consisting of the inner cylinder 87 and the main body 74*a* of the piston 74, and the second storage portion 15 consisting of the thick cylinder portion 86*c* of the outer cylinder 86 and the main body 74*a* of the piston 74. And, the space between the container body 81 and the cylinder member 82 serves as the pressurizing agent housing portion 16 (pressurizing space).

In this embodiment, the piston 74 is made to be a tubular body, but it may be made to be a solid body. The two-fluid discharge container 80 of FIG. 11 is also, same as the two-fluid container 70 of FIG. 10, operated by using the push button 76 which pushes the two stems simultaneously, and discharges the first content 18 and the second content 19 simultaneously. Moreover, as the valve assembly of the two-fluid discharge container 80, it may be used with that which has the stem for two-fluid discharge as shown in FIG. 1.

Figure 12:
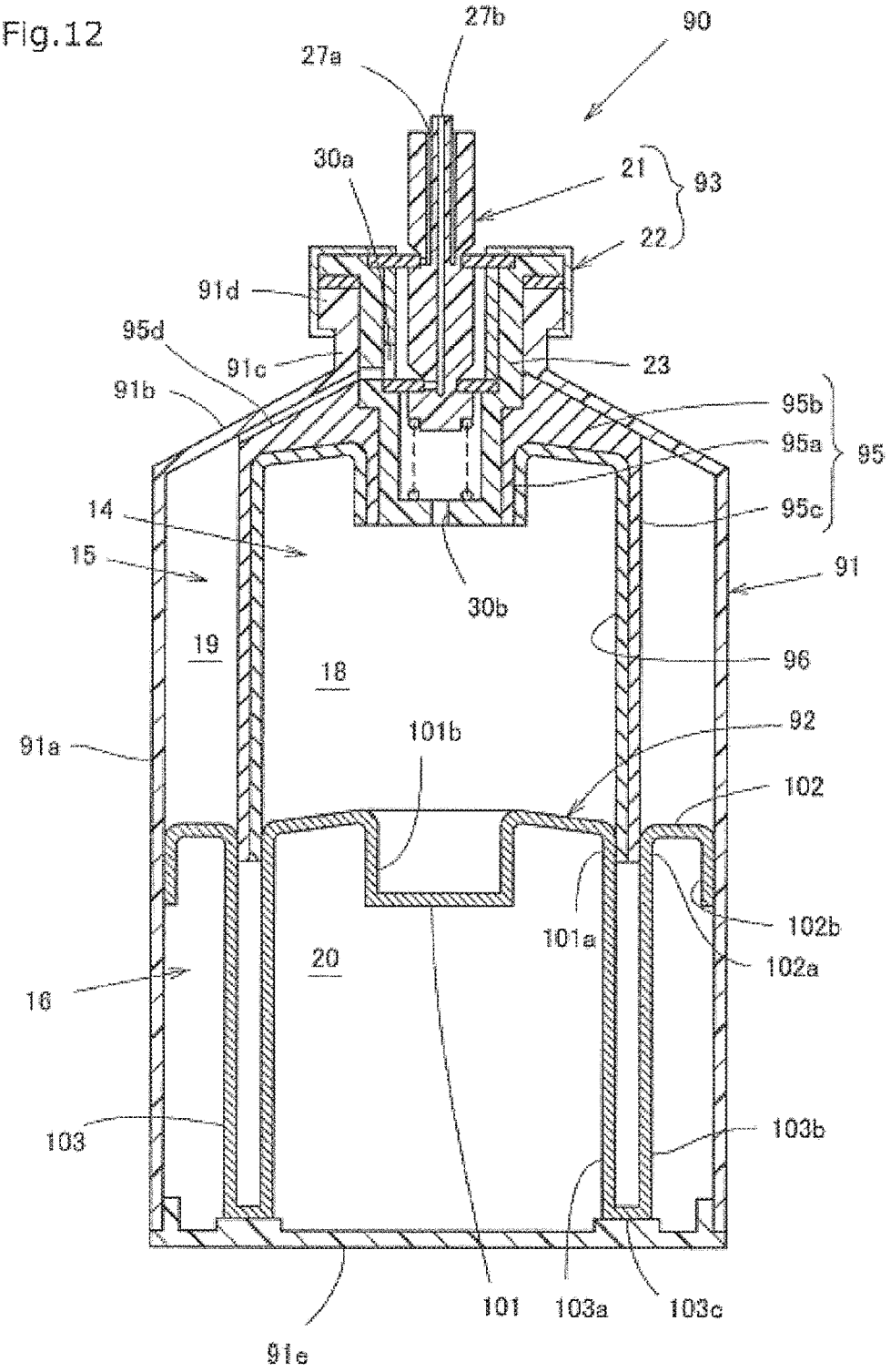
FIG. 12 is a cross-sectional view showing further another embodiment of the two-liquid discharge container of the piston coaxial type of the present invention.

The two-fluid discharge container 90 of FIG. 12 is that which is a piston type, in which the concentric circular first storage portion 14 and the second storage portion 15 are provided to be substantially the same height (the same position in the axial direction). The two-fluid discharge container 90 is an aerosol container equipped with a container body 91, a piston 92 which partitions the inside space thereof into two spaces of a compressing space and a pressurizing space in the vertical direction, and a valve assembly 93 which closes the upper opening of the container body 91 and performs the communication/shut off between the compressing space and outside air.

The container body 91 is a pressure resistant container made of synthetic resin provided with a cylindrical body portion 91*a*, a taper like shoulder portion 91*b* formed on the upper end of the body portion, a cylindrical neck portion 91*c* formed on the upper end of the shoulder portion, and a flange portion 91*d* protruding outward radially in the upper end of the neck portion. In the lower end of the body portion 91*a*, a bottom lid 91*e* is firmly fixed. In the two-fluid discharge container in which the first storage portion 14 and the second storage portion 15 are provided substantially in the same height, different to the embodiment up to FIG. 1-FIG. 5, FIG. 7-FIG. 10, the body portion 11*a* is of the shape of uniform cylindrical body. As the synthetic resin of the container body 91, thermoplastic resin such as polyethylene terephthalate, polycyclohexanedimethylene terephthalate, polyarylate, nylon can be cited.

In addition, the shape of the container body 91 is not particularly limited. For example, the shoulder portion and the neck portion may be omitted and the upper end of the body portion 91*a* may be opened.

In the container body 91, a partition wall member 95 which partitions the compressing space of the upper side of the container body 91 into the first storage portion 14 and the second storage portion 15 is provided. The partition member 95 consists of a tubular housing connecting portion 95*a* connected to the outer periphery of the housing 23 of a valve assembly 93 later described, a taper portion 95*b* extending along the lower surface of the shoulder portion 91*b* from the upper end thereof, and a tubular partition wall portion 95*c* being the lower end thereof, extending downward from approximately mid portion of the shoulder portion 91*b*.

However, the partition wall member 95 may be only provided with the tubular partition wall portion 95*c* extending downward from the lower surface of the shoulder portion 91*b* of the container body 91. Moreover, in the upper surface (in between the shoulder portion 91*b* of the container body 91) of the connecting portion 95*a* of the partition wall member 95, a groove portion 95*d* extending up to the outside of the partition wall portion 95*c* along the shoulder portion 91*b* is formed. This serves as a passage to connect between the valve assembly 93 and the second storage portion 15 as described later. The partition wall portion 95*c* extends up to approximately mid portion in the height direction of the body portion 91*a* of the container body 91. In addition, the groove portion 95*d* may be provided in the inner surface of the shoulder portion 91*b* of the container body 91. In this embodiment, the partition wall member 95 is of a double layer structure. In other words, a cylinder 96 is provided in the inner surface of the partition wall member 95, and the first storage portion 14 is composed by the cylinder 96. For example, the partition wall member 95 is formed from synthetic resin such as polyethylene terephthalate, polybutylene terephthalate, nylon, polypropylene, polyacetal, the cylinder 96 is made from alkali-resistant resin such as polyethylene, nylon, and glass, thereby, the first storage portion 14 can be made to have durability against an undiluted alkali solution (two-fluid type hair dye first agent). The partition wall member 95 may be only that which can partition the body portion 91*a* of the container body 91 at least into two of the first storage portion 14 and the second storage portion 15 of the same height position. For example, the partition wall portion 95*c* may be provided so as to extend downward from the housing of the valve assembly, and may be designed properly according to the shape of the container body 91.

The piston 92 consists of a disc-shaped first piston 101 which contracts the first storage portion 14 and a ring like second piston 102 which contracts the second storage portion 15, and a connecting portion 103 connecting those.

The outer edge portion 101*a* of the first piston 101 is composed so as to slide on the inner surface of the cylinder 96 (the partition wall portion 95*c*) of the partition wall member 95. Moreover, in order to contract the first storage portion efficiently, in the first piston 101, a recess is provided in the same shape as the lower end of the housing 23 so that being capable of contacting the housing 23 of the valve assembly 93. In this embodiment, a cylindrical recessed portion 101*b* is formed so as to be capable of engaging with the lower end of the housing 23. The inner edge portion 102*a* of the second piston 102 slides on the outer surface of the partition wall portion 95*c* of the partition member 95, the outer edge portion 102*b* slides on the body portion 91*a* of the container body 91. The outer edge portion 102*b* faces downward along the body portion 91*a* of the container body 91, and is composed so as to bend somewhat by the pressure from above.

The connecting portion 103 consists of a tubular inner wall 103*a* extending downward from the outer edge portion 101*a* of the first piston 101, a tubular outer wall 103*b* extending downward from the inner edge portion 102*a* of the second piston 102, and a ring like connecting bridge 103*c* connecting those lower end. The height of the inner wall 103*a* and the outer wall 103*b* are substantially same as the height of the partition wall portion 95*b* or somewhat higher than the height of the partition wall portion 95*b*. And, by the moving up of the piston 92, the tubular gap between the inner wall 103*a* and the outer wall 103*b*, a tubular partitioning wall portion 95*c* is inserted. The partitioning wall portion 95*b* and the connecting portion 103 may be slid or not. In the case of being slid, a guide action can be obtained when the piston 92 is moved vertically. The piston as described above is formed from synthetic resin such as polyethylene terephthalate, polybutylene terephthalate, nylon, polyethylene, polypropylene, polyacetal. In addition, in order to enhance chemical resistant property, a tip member may be provided same as FIG. 3.

The first storage portion 14 is inside of the partitioning wall portion 95*c* of the partitioning wall member 95, and is a columnar space surrounded by the upper end surface of the first piston 101 and the valve assembly 93 (cap portion). And, the second storage portion 15 is a cylindrical space surrounded by the inner surface of the container body 91, the outer surface of the partition wall portion 95, and the upper end surface of the second piston 102. Further, the pressurizing space 16 is inside of the body portion 11*a* of the container body 91, and is a columnar space surrounded by the lower surface of the piston 92 and the bottom lid 91*e* of the container body 91. These three spaces are provided coaxially with the center axis of the container body 91, and in the top view, these are the circular first storage portion 14 being in the center, and the ring like second storage portion 15 provided in the outer periphery thereof. Further, the first storage portion 14 and the second storage portion 15 are substantially adjoining through the partition wall portion 95*b* in the top view.

Each cross sectional area of the first storage portion 14 and the second storage portion 15 are made so as to be the ratio correspondent to the discharge amount ratio. In the case of equal amount discharge, the cross sectional area is made to be the same, where the inner diameter r of the partitioning wall portion 95*b* and the inner diameter R of the body portion 11*a* of the container body satisfies the following formula.

[Mathematic Formula 1]

$$R=\sqrt{2\cdot r} \qquad \text{(Formula)}$$

The valve assembly 93 is equipped with the valve mechanism 21 which communicates/shuts off the first passage connecting the first storage portion 14 and the exterior and the second passage connecting the second storage portion 15 and the exterior, and a cover cap 22 for fixing the valve mechanism 21 to the opening portion of the container body 11. The valve assembly 93 acts also as the lid portion of the container body 91. The first passage communicating with the first storage portion 14 of the valve mechanism 21 reaches the lower communicating hole 30*b* from the second intra-stem passage 27*b*, and the second passage communicating with the second storage portion 15 reaches the upper communicating hole 30*a*, the groove portion 95*d* of the partition wall member 95 from the first intra-stem passage 27*a*. Another composition is that which is same as the valve mechanism 21 of FIG. 1.

As the method to fill the pressurizing agent 20, the content 18, 19 in the two-fluid discharge container 90, the partition wall member 95 is inserted from the lower end of the body portion 91*a* of the container body to which the valve assembly 93 is firmly fixed, and is connected to the housing 23 of the valve assembly 93, then, the piston 92 is inserted, and the bottom lid 91*e* is firmly fixed. After that, the pressurizing agent 20 is filled in the second storage portion 15 through the second passage of the valve assembly 93. At this moment, the outer edge portion 102*b* of the second piston 102 of the piston 92 bends downward, from the gap thereof, the pressurizing agent 20 is filled in the pressurizing space 16. The piston 92 is moved upward by pushing down the stem 24 to exhaust air in the first storage portion 14 and the second storage portion 15. After that, from the second intra-stem passage 27*b* and the first intra-stem passage 27*a*, the first content 18 and the second content 19 are filled respectively in the first storage portion 14 and the second storage portion 15 while lowering the piston 92.

Figure 13:
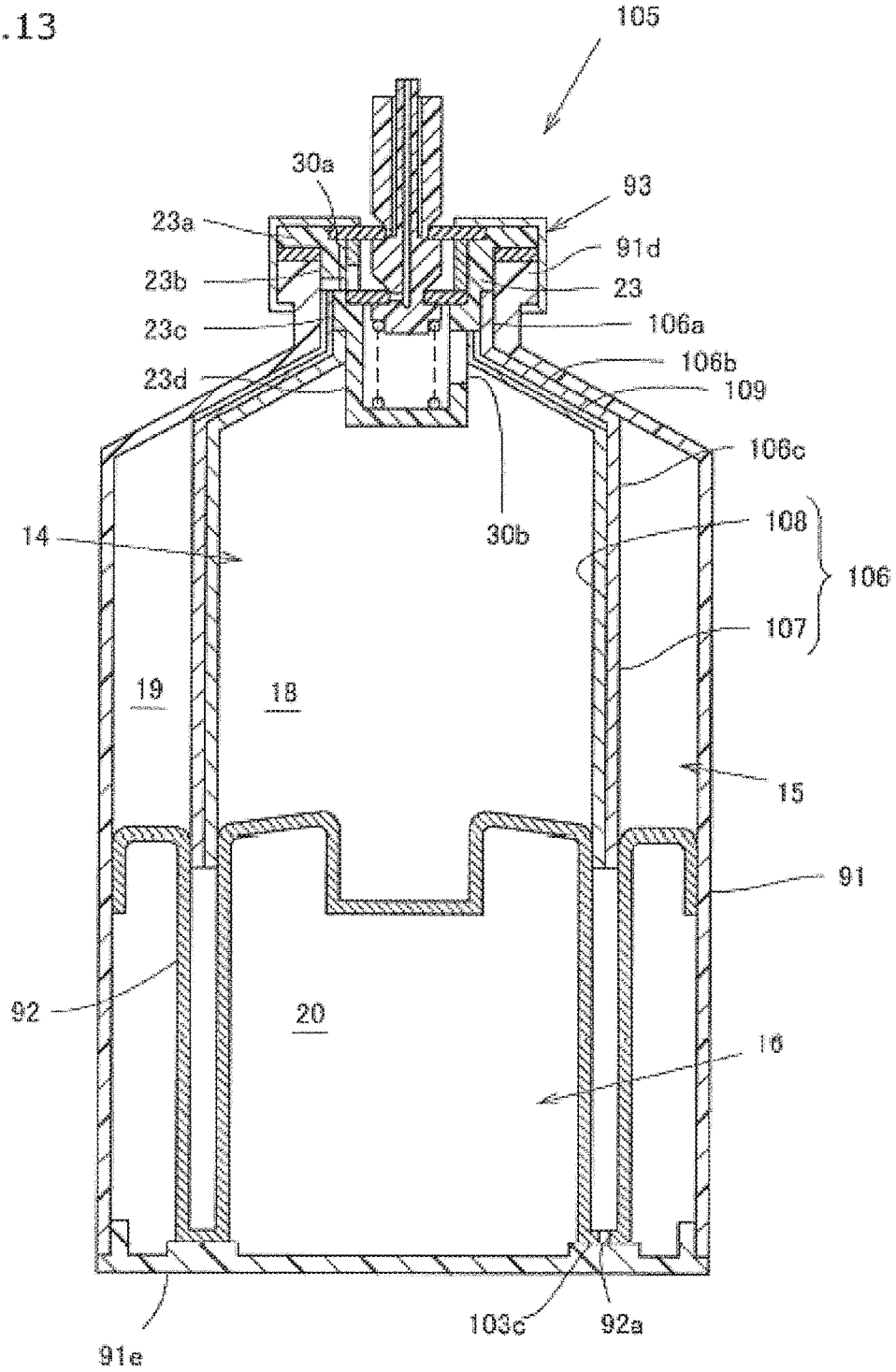
FIG. 13 is a cross-sectional view showing further another embodiment of the two-liquid discharge container of the piston coaxial type of the present invention.

The two-fluid discharge container 105 of FIG. 13 is that in which a gas passage 109 communicating the opening portion of the partition wall member 106 and the pressurizing agent housing portion 16 is formed between the body 107 of the outer layer of the partition wall 106 being a double layer structure and the sliding layer 108 of the inner layer.

The housing 23 of the valve assembly 93 has a large diameter portion 23*b* which is inserted into the opening portion of the flange portion 91*d* of the container body 91 and closes the opening portion thereof, a middle diameter portion 23*c* which is inserted into the opening portion of the body portion 107 of the partition wall member 106 and closes the opening thereof, a small diameter portion 23*d* which is inserted into the opening portion of the sliding layer 108 of the partition wall member 106 and closes the opening portion thereof. The upper communicating hole 30*a* is provided in the lower end of the large diameter portion 23*b*. And, the lower communicating hole 30*b* of the housing 23 is provided in the upper portion of the small diameter portion 23*d*. The upper end flange 23*a* protruding outward radially is formed in the upper end of the large diameter portion 23*b*.

The partition wall member 106 consists of a tubular housing connecting portion 106*a* engaging with the middle diameter portion 23*c* of the housing 23, a taper portion 106*b* extending along the lower surface of the shoulder portion 91*b* from the lower end thereof, and a tubular partition wall member 106*c* extending downward from the approximately middle portion of the shoulder portion 91*b*, being the lower end thereof. Hence, the opening portion of the partition wall member 106 (the upper end of the housing connecting portion 106*a*) faces upward. In addition, the upper end of the sliding layer 108 is formed to be somewhat lower than the upper end of the body 107. Therefore, it is constituted so that the upper end of the body 107 contacts or adjoins the lower surface of the large diameter portion 23*b*, and the upper end of the sliding layer 108 contacts or adjoins the lower surface of the middle diameter portion 23*c*. And, in the housing connecting portion 106*a* of the partition wall member 106 and the taper portion 106*b*, a gap extending vertically is formed between the body 107 and the sliding layer 108. This gap is formed either in the body or in the sliding layer 108 by providing a groove etc.

In the connecting bridge 103*c* of the piston 92, a through hole 92*a* is formed. Another composition is substantially same as that the two-fluid discharge container 90 of FIG. 12.

Figure 14:
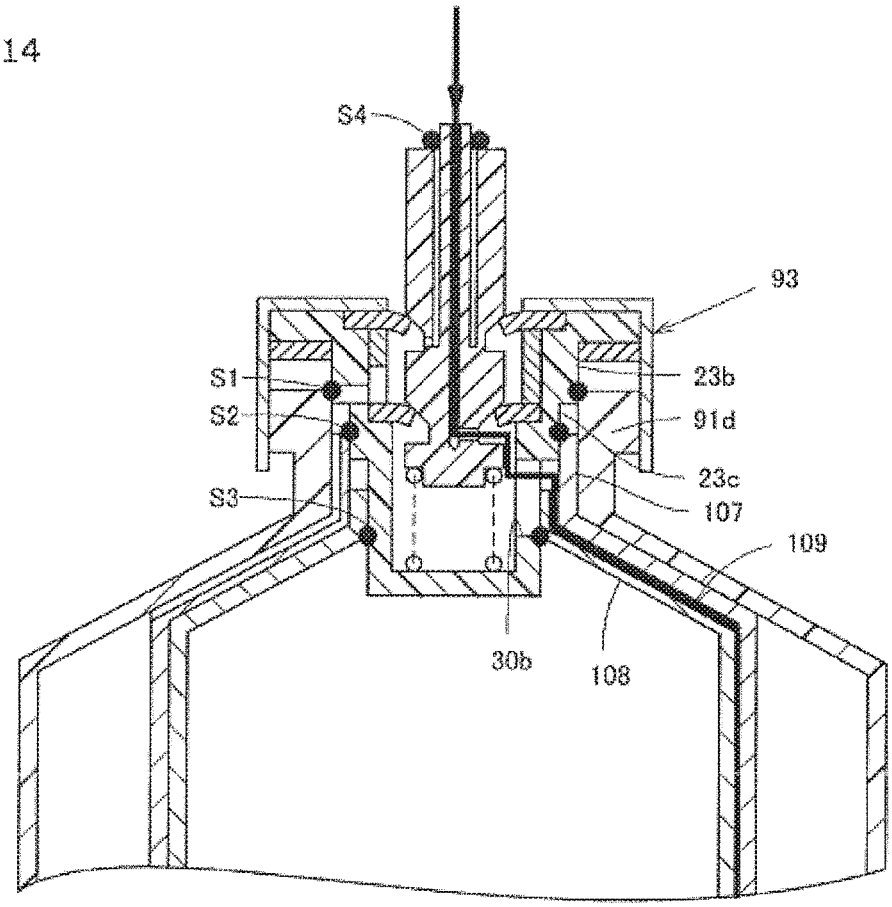
FIG. 14 is a cross-sectional view showing the filling process of a pressurizing agent into the two-liquid discharge container of FIG. 13.

As the method for filling the pressurizing agent 20, the content 18, 19 in this two-fluid discharge container 105, from the lower end of the body portion 91*a* of the container body 91, the partition wall member 106 and the piston 92 are inserted, and the bottom lid 91*e* is firmly fixed. Then, the first content and the second content are filled in the first storage portion 14 and the second storage portion 15 from the opening portion of the container body 91. After that, the valve assembly 93 is arranged above the flange portion 91*d* of the container body 91. And, as shown in FIG. 14, the valve assembly 93 is lowered so that between the large diameter portion 23*b* of the valve assembly 23 and the opening portion (flange portion 91*d*) of the container body 91 (S1), between the middle diameter portion 23*c* of the housing 23 and the opening portion of the body 107 of the partition wall member 106 (S2), and between the lower communicating hole 30*b* of the housing 23 and the sliding layer 108 (S3) are sealed, further, the opening portion (S4) of the first intra-stem passage 27*a* is sealed, the pressurizing agent (nitrogen gas) is filled from the second intra-stem passage 27*b*. Thereby, the pressurizing agent passes through the lower communicating hole 30*b* from the second intra-stem passage 27*b*, passes through the gas passage 109 between the body 107 of the partition wall member 106 and the sliding layer 108, and passes through the through hole 92*a* of the connecting bridge 103*c* of the piston 92, and reaches the inside of the pressurizing space 16. At this moment, in the partition wall portion 106*c*, although a gap is not formed between the body 107 and the sliding layer 108, a little bending of each of or one of the body 107 and the sliding layer 108 allows the pressurizing agent to pass through. Turning back to FIG. 13, at the same time with the filling of the pressurizing agent, the valve assembly 93 is lowered further, and the cover cap 22 is swaged to close the container body 91.

Figure 15A:
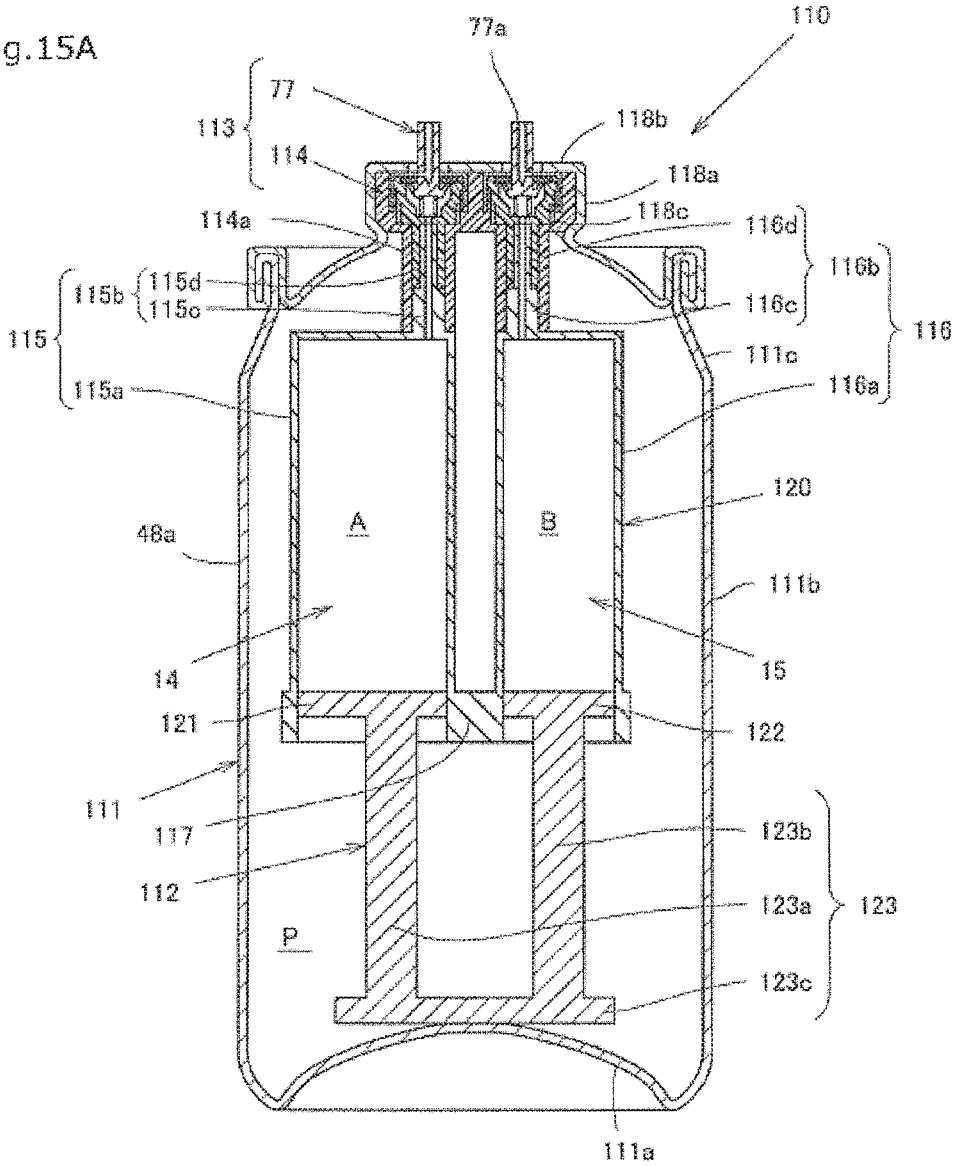
FIG. 15A is a cross-sectional view showing an embodiment of the two-liquid discharge container of the piston parallel type of the present invention.
Figure 15B:
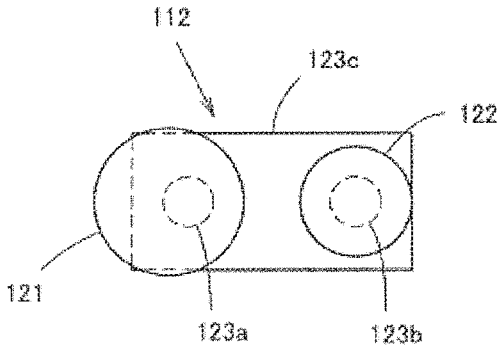
FIG. 15B is a plain view showing the piston.

The two-fluid discharge container 110 of FIG. 15 is that in which two tubular cylinder members are provided in parallel in the container body. In detail, it is provided with a container body 111, a first cylinder member 115 and a second cylinder member 116 accommodated inside thereof, a piston 112 accommodated so as to be freely movable vertically in the container body, and a valve assembly 113 which communicates the inside of the first cylinder member 5 (the first storage portion 14) and the inside of the second cylinder member 116 (the second storage portion 15) with the exterior. The piston 112 partitions the inside of the container body 111 into the inside (compressing space) of the first cylinder member 115 and the inside of the second cylinder member 116 and the pressurizing space which is the outside thereof. In other words, the pressurizing agent P is filled in the whole of the inside of the container body 111, stated differently, in the space covering the first cylinder member 115 and the second cylinder member 116. In addition, this discharge container 110 also is used by using the mechanism which releases simultaneously the two stems such as the push button 30 of FIG. 1.

The container body 111 consists of a bottom portion 111*a*, a body portion 111*b*, a shoulder portion 111*c*, and a lid member 111*d* closing the upper end thereof. In the lid member 111*d*, a holder retaining portion 118 which retains the valve holder of the later described valve assembly 113 is formed. The holder retaining portion 118 consists of a cylindrical side wall portion 118*a* and the upper bottom portion 118*b* closing the upper end thereof. In the lower end of the side wall portion 118*a*, an annular engaging protrusion 118*c* is formed, in the upper bottom portion 118*b*, two of insertion holes 118*d* passing through the stem are formed. In this embodiment, it consists of a container member comprising the bottom portion 111*a*, the body portion 111*b*, and the shoulder portion 111*c*, and the lid member 111*d*, the container member and the lid member 111*d* are firmly fixed by double seaming. The container body 111 as described above can be formed of metal material such as tin plate. However, the bottom portion 111*a* may be made to be a separate member, and to be a three-piece can of a bottom portion, a body portion, and a lid portion. In addition, as the discharge container of FIG. 1, the container body may be closed by the valve assembly 113.

The lower ends of the first cylinder member 115 and the second cylinder member 116 are connected by a connecting bridge 117. In this embodiment, the first cylinder member 115 and the second cylinder member 116 are integrally formed. However, the first cylinder member 115 and the second cylinder member 116 may be integrated by connecting with a connecting member. By integrating the first cylinder member 115 and the second cylinder member 116 as described above, the handling of the discharge container 110 when assembling becomes easy. In addition, each may be made to be a separate body.

The first cylinder member 115 consists of a cylindrical body 115*a* and a valve connecting portion 115*b* extending upward from the upper end thereof. The body 115*a* has an upper bottom and the lower end is opened.

The valve connecting portion 115*b* consists of a connecting base portion 115*c* and a diameter reduced connecting tip portion 115*d* extending from the upper end thereof. However, the structure is not particularly limited as long as it is capable of being connected with the later described aerosol valve. In addition, the valve connecting portion 115*b* is the upper bottom of the body 115*a*, and is formed in a position deviated to the center side of the pressure resistant container 111.

The second cylinder member 116 also consists of a cylindrical body 116*a* and a valve connecting portion 116*b* extending upward from the upper end thereof. The body 116*a* of the second cylinder member also has the upper bottom and the lower end is opened, And, the valve connecting portion 116*b* of the second cylinder member is also equipped with a connecting base portion 116*c* and the connecting tip portion 116*d* same as the first cylinder member 115, and is formed in a position deviated to the center side of the pressure resistant container 111. Each connecting base portion 115*c* 116*c* of each valve connecting portion 115*b*, 116*b* is inserted into an attaching portion 114*a* of a later described valve holder 114, the connecting tip portion 115*d*, 116*d* are inserted into a tube connecting portion 26*f* of an aerosol valve 113. However, the valve connecting portion may be connected to either one of the tube connecting portion of the aerosol valve or the attaching portion of the valve holder.

The body 116*a* of the second cylinder member is made to be the same position with the body 115*a* of the first cylinder member 115*a*, and is made to be the same height with the body 115*a*. Meanwhile, the cross sectional area is made to be smaller than the body 115*a*. In other words, the inner diameter is made small. Hence, the discharge amount corresponds to each cross sectional area. However, it can be made to be an equal diameter so as to be the same discharge amount.

Moreover, each body is made to be cylindrical, but it is not particularly limited as long as it is tubular. For example, it may be polygon tube such as triangle tube, square tube, or be other shapes such as semicircular.

The piston 112 has, as shown in FIG. 15A, B, a disc like first piston 121 which pressurizes the inside of the first cylinder member (the first storage portion 14) 115, a disc like second piston 122 which pressurizes the inside of the second cylinder member (the second storage portion 15) 116, and a connecting portion 123 connecting those.

The first piston 121 and the second piston 122 slide on the inner surface of the body 115*a* of the first cylinder member 115 and the inner surface of the body 116*a* of the second cylinder member 116 while maintaining sealability.

The connecting portion 123 consists of a first leg portion 123*a* extending from the lower surface of the first piston 121, a second leg portion 123*b* extending from the lower surface of the second piston 122, and a connecting plate 123*c* connecting those. The height of the first leg portion 123*a* and the second leg portion 123*b* are made to be same. Hence, the first piston 121 and the second piston 122 are composed so as to contact the upper surface of the cylinder (the undeluded solution storage portion S1, S2) simultaneously.

A pressurizing member 112 moves up and down corresponding to the first piston or the second piston whose resistance generated by the viscosity of the undeluded solution and the cross sectional area of the cylinder (the undeluded solution storage portion) is larger.

The valve assembly 113 consists of the valve holder 114 and the aerosol 77 held by the valve holder 114. The aerosol valve 77 is substantially same as the aerosol valve 77 of the two-fluid discharge container 80 of FIG. 11.

The valve holder 114 is that which is held by the lid member 111*d* of the container body 111, and in which two valve holding portions 118 penetrating the valve holder 114 vertically are formed. Moreover, the two tubular attaching portions 114*a* extending from the lower end of the valve holding portion 118 is formed. The valve holder 114 is retained by the lid member 111*d* so as to be sandwiched between the upper bottom 118*b* of the valve holding portion 118 and the engaging protrusion 118*c*.

The manufacturing method of the discharge container 110, the filling method of the undeluded solution and the pressurizing agent into the manufactured discharge container 110 is as follows. A container member is formed by drawing, ironing etc. from a metal plate such as aluminum. Meanwhile, the valve holder 114 is made to hold the aerosol valve 77, the valve holder 114 is attached to the lid member 111*d*. Separately, that in which the piston 112 is attached and set to the first cylinder member 115 and the second cylinder member 116 is attached to the attaching portion 114*a* of the valve holder. Stated differently, the piston 112, the aerosol valve 77, the valve holder 114, the two cylinder members, and the lid member 111*d* are made to be integrated. The integrated lid member 111*d* is capped on the container member. And, the pressurizing agent is filled from between the lid member 111*d* and the container member, and at the same time, the container member and the lid member 111*d* is fixed by double seaming. After that, operating the stem 77*a* of each aerosol valve 77, remaining air in the space of the first cylinder member 115 (the first storage portion 14) and the space of the second cylinder member 116 (the second storage portion 15) is exhausted. In other words, the first piston 121 and the second piston 122 are made to move up to the upper end. At the end, from each stem 77*a*, a first undeluded solution A and a second undeluded solution B are filled. In addition, when the first cylinder member 115 and the first piston 121, the second cylinder member 116 and the second piston 122 are joined together so that the capacity of the first storage portion 14 and the second storage portion 15 becomes maximum, in the case that the distance between the upper end of the first cylinder member 115 and the lower end of the first piston 121 and the distance between the upper end of the second cylinder member 116 and the lower end of the second piston 122 are larger than the height of the container member, at the time when the integrated lid member 111*d* is lowered from above the container body, the lower end of the first piston 121 and the second piston 122 contact the bottom of the container member making it possible to form a gap between the container member and the integrated lid member 111*d*. Hence, by utilizing the gap, the pressurizing agent is easy to be filled.

In this discharge container 110 also, the first piston portion 121 and the second piston portion 122 of the piston 112 receives the same pressure, and since the both pistons are integrated, when the two aerosol valve are opened, the moving amount becomes the same amount. Moreover, in this discharge container 110, the first cylinder member 115 and the second cylinder member 116 have a different capacity, but it is capable of discharging the discharge amount corresponding to this volume ratio. In addition, the capacity of the first cylinder member 115 and the second cylinder member 116 can be made to be the same capacity.

These volume ratios can be selected properly according to the kinds of the undeluded solutions and the methods of use. Moreover, the discharge container 110 is that in which the tubular cylinder member (storage portion) is provided in the container body 111, and since the storage portion is independent to the container body, it is possible to adjust the discharge amount (capacity) of the undeluded solution by only attaching the cylinder of a selected cross sectional area and the piston to the valve assembly.

Figure 16A:
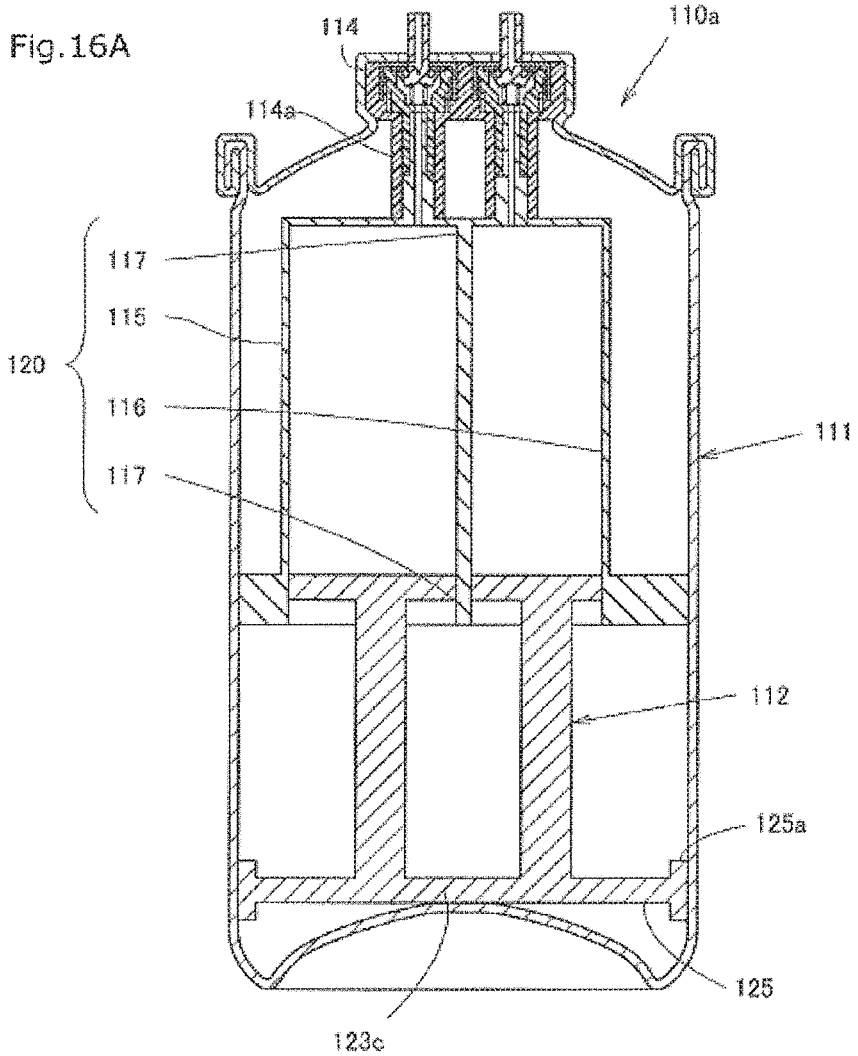
FIG. 16A is a side view showing another embodiment of the two-liquid discharge container of the piston parallel type of the present invention.
Figure 16B:
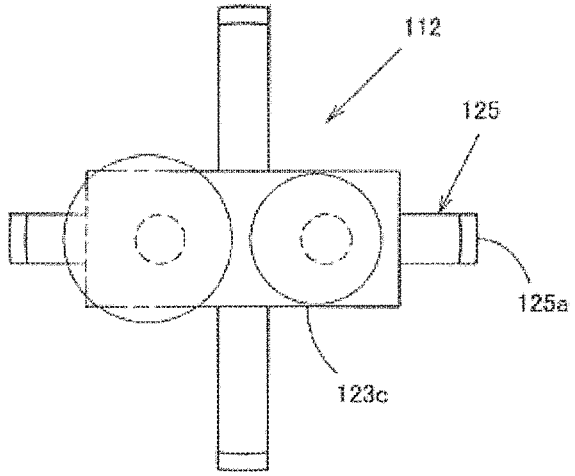
FIG. 16B is a plain view showing the piston.

In the two-fluid discharge container 110*a* of FIG. 16, a connecting plate 123*c* of the connecting portion 123 of the piston 112 protrudes outward in the radial direction, the tip thereof has a plurality of guide legs 125 contacting the inner surface of the pressure resistant container 111. In this embodiment, as shown in FIG. 16B, four guide legs 125 extend radially at an equal interval. The tip 125*a* of the guide leg 125 has a cross section of circular arc so as to slide on the inner surface of the pressure resistant container 111 stably. As described above, by providing the guide leg 125, even if the resistance received by the first piston and the second piston differs largely due to the viscosity difference of the first undeluded solution and the second undeluded solution, it is possible to prevent the vertical position of the first piston 121 and the second piston 122 from deviating, and the second piston 112 from inclining. Moreover, in the discharge container 110*a*, the connecting bridge 117 is provided also in the upper end of the first cylinder member 115 and the second cylinder member 116, the first cylinder member 115 and the second cylinder member 116 are also firmly connected. Thereby, the handling when assembling is easy. Further, the lower end periphery of the first cylinder member 115 and the second cylinder member 116 is made to contact with the inner surface of the container body 111, and is held stably. Hence, even if the two-fluid discharge container 110*a* is dropped by accident, there occurs no problem such that the attached portion of the valve connecting portion and the valve holder 114 is broken or bent, making it possible to move the piston more stably. Another composition is same as the discharge container 110 of FIG. 15.

Figure 17A:
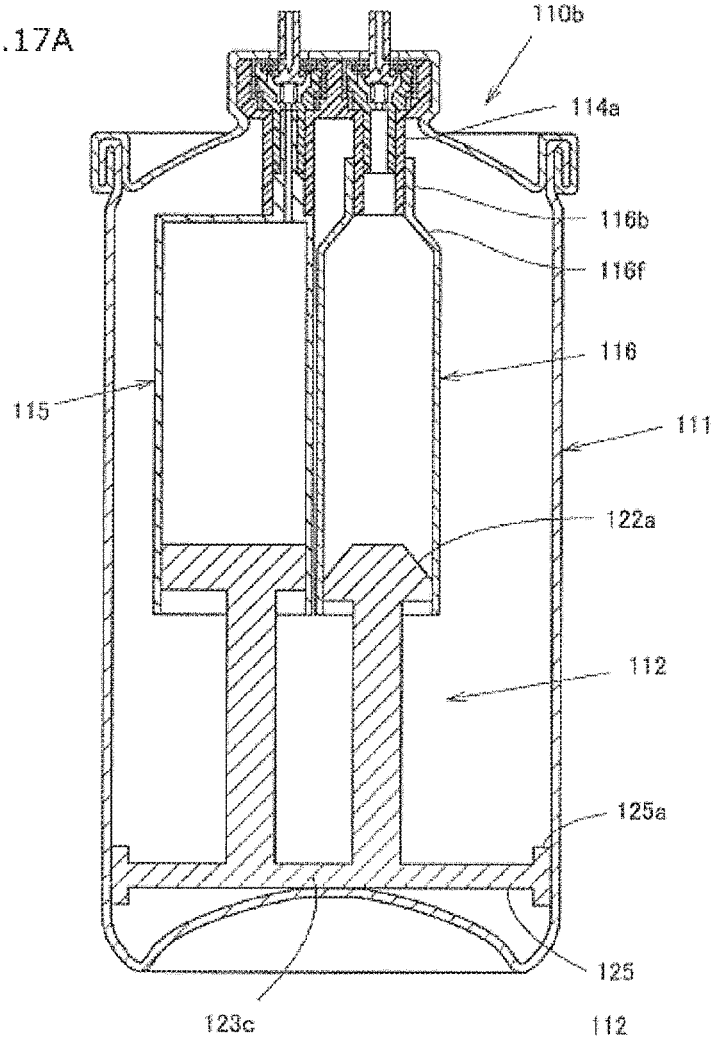
FIG. 17A is a side view showing further another embodiment of the two-liquid discharge container of the piston parallel type of the present invention.
Figure 17B:
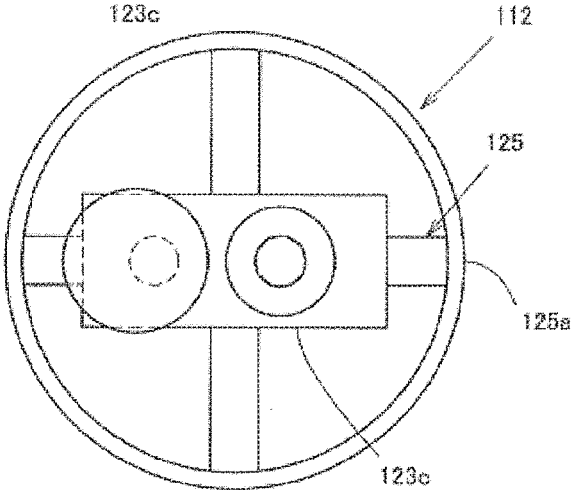
FIG. 17B is a plain view showing the piston.

In the two-fluid discharge container 110*b* of FIG. 17, different to the discharge container 110 of FIG. 15 and the discharge container 110*a* of FIG. 16, the first cylinder member 115 and the second cylinder member 116 are independent. The first cylinder member 115 is substantially same as the first cylinder member 110 of FIG. 15 excepting that it is not provided with the connecting bridge 117.

The second cylinder member 116 differs to the second cylinder member 116 of the discharge container of FIG. 15 in the point that the upper portion 116*f* is of a taper shape, being diameter reduced toward upper portion thereof, and in the point that the valve connecting portion 116*b* is composed so as to be attached to the outer periphery of the attaching portion 114*a* of the valve holder. Another composition is same as the discharge container 110 of FIG. 15. In this embodiment, the first cylinder member 115 is made of synthetic resin, the second cylinder member 116 is made of metal (aluminum, aluminum alloy, tin plate, stainless). As described above, by making the first cylinder member 115 and the second cylinder member 116 be a separate body, the material quality can be properly selected in accordance with the content filled in each cylinder, it becomes possible to store the contents stably for a long period. Particularly, in the case that it is made of metal, the permeation of the components of the undeluded solution and the pressurizing agent can be preferably prevented.

In the piston 112 of the discharge container 110*b*, the shape of the upper surface 122*a* (pressurizing portion) of the second piston 122 is different to that of the second piston 122 of the discharge container 110 of FIG. 15. Stated differently, it is formed to be mountain-shaped so as to be capable of contacting tightly to the inner surface of the upper portion 116*f* of the second cylinder member 116. Moreover, the guide leg 125 of the piston 112 is made to be ring like. The other composition is same as the discharge container 110*a* of FIG. 16.

In addition, the connecting plate 123*c* may be made to be disc-shaped, and in the outer periphery thereof, the ring like guide leg 125 may be made to slide on the inner surface of the container body 111. Particularly, by making the guide leg 125 and the inner surface of the container body 111 contact while having sealability, the inside of the container body 111 can be partitioned into the compressing space and the pressurizing space.

Figure 18A:
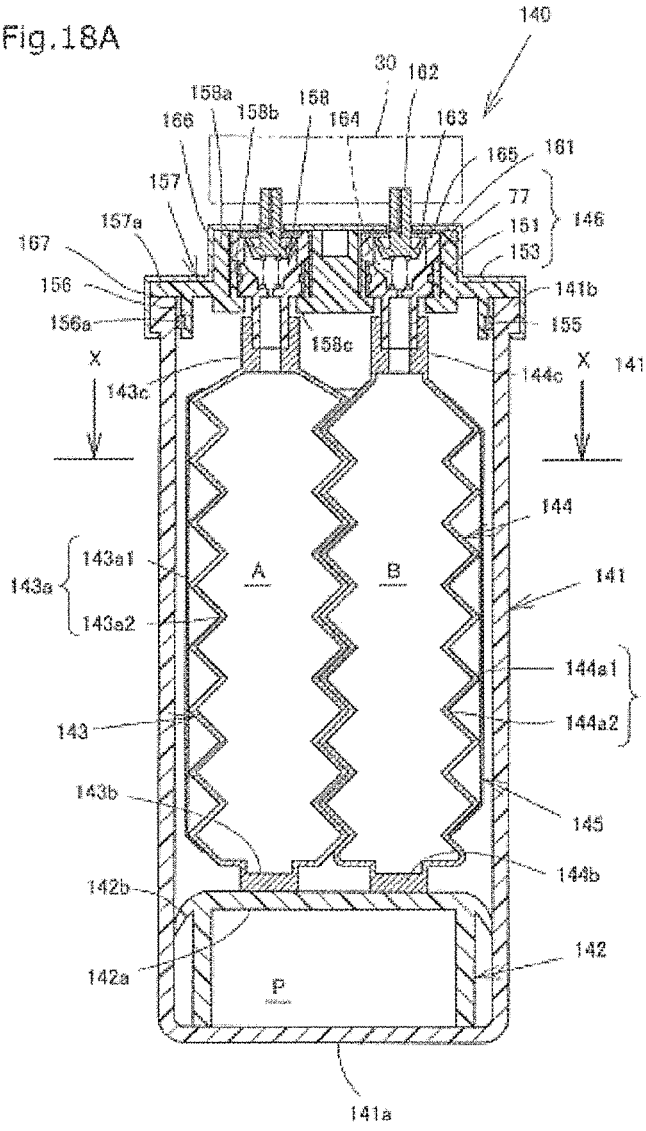
FIG. 18A is a cross-sectional view showing an embodiment of the two-liquid discharge container of vertically extending and contracting type of the present invention.

The two-fluid discharge container 140 of FIG. 18 is that in which a first storage portion 143 and a second storage portion 144 extend and contract vertically. In detail, it has a container body 141, a piston 142 which partitions the inside of the container body 141 into the compressing space and the pressurizing space, the first storage container 143 equipped with a bellows-shaped body portion (first bellows portion) which extends and contracts vertically, being accommodated in the compressing space, the second storage container 144 equipped with a bellows-shaped body portion (second bellows portion) 144*a* which extends and contracts vertically, being accommodated in the compressing space S1, a film 145 stretched around the outer periphery of the first storage container 143 and the second storage container 144, and a valve assembly 146 which closes the opening portion of the container body 141, and opens and closes the passage communicating the first storage container 143 and the second storage container 144 with the exterior.

In the first storage container 143 and the second storage container 144, the mountain portion 144*a*1 of the second bellows portion (the second body portion 144*a* of the second storage container) is inserted into the valley portion 143*a*2 of the first bellows portion (the body portion 143*a* of the first storage container), the mountain portion 143*a*1 of the first bellows portion in inserted into the valley portion 144*a*2 of the second bellows portion, extending and contracting vertically in a state superimposed in parallel.

By filling the first content A and the second content B in the first storage container 143 and the second storage container 144 of the discharge container 140 respectively, it becomes a two-fluid discharge product.

The container body 141 is a cylindrical hard body equipped with a bottom portion 141*a*, in which a flange portion 141*b* protruding outward in the radial direction is formed in the upper end. The inner diameter is made to be uniform. However, as long as the inner diameter is uniform in the range in which the piston slides, the shape thereof is not particularly limited.

The container body 141 is formed of synthetic resin such as polyethylene terephthalate, nylon. For example, synthetic resin is made into a preform by extrusion forming. Further, the preform can be formed by biaxial stretch blow molding. However, it may be formed from metal such as aluminum.

The piston 142 is a tubular hard body equipped with an upper bottom 142*a*, in the upper end thereof, an annular blade 142*b* protruding outward in the radial direction is formed. The blade 142*b* is a portion having flexibility extending downward. The piston 142 slides on the inner surface of the container body 141 while maintaining sealability, and partitions the inside of the container body 141 into the compressing space and the pressurizing space. Moreover, since it is equipped with the blade 142*b*, it allows the flow of fluid in the downward direction, constituting a check valve to block the flow of the fluid in the upward direction. Thereby, the pressurizing agent P can be filled in the pressurizing space below the piston 142. The shape of the upper bottom 142*a* is not particularly limited as long as it can press the bottom portion 143*b* of the first storage portion 143 and the bottom portion 144*b* of the second storage portion 144 simultaneously. By constituting so that it can press those simultaneously, the degree of contraction of the first storage portion 143 and the second storage portion 144 can be made the same more precisely.

As the piston 142, synthetic resin such as polyethylene terephthalate, nylon, polyethylene, polypropylene, polyacetal, or that which is formed from natural rubber, synthetic rubber by injection molding are used.

The first storage container 143 is equipped with the bellows-shaped body portion 143*a*, a bottom portion 143*b* closing the lower end of the body portion 143*a*, and a tubular valve connecting portion 143*c* provided in the upper end of the body portion 143*a*. The second storage container 144 has also substantially the same composition as the first storage container 143, and is equipped with a body portion 144*a*, a bottom portion 144*b*, and a valve connecting portion 141*c*. In the first storage container 143 and the second storage container 144, the mountain portion 143*a*1 of bellows of the body portion 143*a* of the first storage container 143 is inserted into the valley portion 144*a*2 of the bellows of the body portion 144*a* of the second storage container 144, the mountain portion 144*a*1 of the body portion 144*a* of the second storage container 144 is inserted into the valley portion 143*a*2 of the body portion 143*a* of the first storage container 143.

Figure 18B:
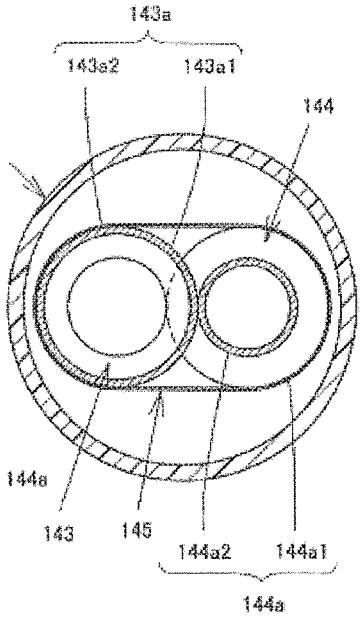
FIG. 18B is an X-X line cross-sectional view thereof.

Stated differently, as shown in FIG. 18B, in the first storage container 143 and the second storage container 144, a part of the body portion 143*a* and the body portion 144*a* are in the state superimposed each other in parallel (superimposed in parallel).

Since the first storage container 143 and the second storage container 144 are arranged as described above, those extend and contract constraining each other. In other words, when the first storage container 143 and the second storage container 144 are contracted by discharging two contents A, B, it is possible to prevent either one or both storage containers from inclining or to prevent either one only from contracting.

Therefore, the bottom portion 143*a* of the first storage container 143 and the bottom portion 144*a* of the second storage container 144 can be moved simultaneously and equidistantly, allowing to discharge two contents A, B at a constant discharge amount ratio always. In this embodiment, since the first storage container 143 and the second storage container 144 have the same diameter, the discharge amount of the two contents A, B becomes same.

The first storage container 143 and the second storage container 144 are formed of polyolefin such as polyethylene, soft synthetic resin such as nylon, rubber such as natural rubber and synthetic rubber. For example, synthetic resin material is formed into a hollow hose body by extrusion molding, and then, is blow-molded immediately to form into a bellows portion. However, it is not particularly limited as long as it can store the contents and has flexibility in a degree to extend and contract vertically.

The film 145 is stretched around the outer periphery of the first storage container 143 and the second storage container 144 in the state superimposed in parallel. By providing the film 145 as described above, it is possible to prevent either one of the first storage container 143 and the second storage container 144 from inclining. In detail, either one of the mountain portion never override the other mountain portion, two storage containers can be held in the state superimposed in parallel. Hence, the first storage container 143 and the second storage container 144 can be extended and contracted securely in the state superimposed in parallel.

As the film 145, polyolefin such as polyethylene, polypropylene, synthetic resin film having thermal contractility such as polystyrene, polyethylene terephthalate, nylon, polyvinylidene fluoride (fluorocarbon) are used.

However, it is not particularly limited as long as it can extend and contract the first storage container 143 and the second storage container 144 in the state superimposed in parallel.

The valve assembly 146 consists of a valve holder 151 closing the opening portion of the container body 141, the aerosol valve 77 held by the valve holder 151, and a cover cap 153 which fixes the aerosol valve 77 to the valve holder 151 and fixes the valve holder 151 to the container body 141. However, the valve assembly 146 is not particularly limited as long as it is equipped with a valve mechanism which closes the container body 141, and can communicate/shut off the passage passing through the two contents. For example, this valve assembly 146 is equipped with two stems, but a stem for two-fluid discharge consisting of a tubular hole provided coaxially with the center hole as the discharge container 10 of FIG. 1 may be used. Moreover, it may be that which opens and closes two independent passages, and may be that which joins together two contents before discharge and opens and closes the common passage. The aerosol valve 77 is same as that of the aerosol valve 77 of the discharge container 70 of FIG. 10.

The valve holder 151 consists of a tubular plug portion 156 and a lid portion 157 which is provided in the upper portion thereof, and closes the opening portion of the container body 141.

The plug portion 156 is a cylindrical body along the opening portion of the container body 141, and in the outer peripheral surface thereof, an annular recessed portion 156*a* holding an O ring 155 is formed. The O ring 155 is compressed between the inner surface of the opening portion of the container body 141 and the annular recessed portion 156*a* in the radial direction and seals between the container body 141 and the plug portion 156. In addition, the seal structure of the valve holder 151 and the container body 141 may be formed by providing a sealing material between the upper end of the container body 141 and the outer peripheral end 157*a* of the lid portion 157. Moreover, the seal structure may be not provided between the valve holder 151 and the container body 141. In this case, for example, when the pressurizing agent is filled in the pressurizing space, the compressing space is compressed by the pressurizing agent pushing up the piston, since the compressed air is exhausted outside from the compressing space, the movement of the piston 142 becomes smooth. Meanwhile, as this embodiment, when sealing is made between the valve holder 151 and the container body 141, the compressing space can be filled or replaced with inactive gas etc. such as nitrogen, the contents of the first storage portion 143 and the second storage portion 144 can be stored stably. For example, it is preferable when a two-liquid reaction type content, particularly, a two-liquid reaction type hair dye is accommodated. In addition, when sealing is made between the valve holder 151 and the container body 141, the pressure in the compressed space increases somewhat by the piston moving upward, but by adjusting the pressure in the pressurizing space, the contents can be discharged to the last.

In the lid portion 157, two tubular holder portions 158 formed so as to penetrate vertically accepting the aerosol valve 77 are formed. The outer periphery end 157*a* of the lid portion 157 protrudes outward than the plug portion 156, and is arranged in the upper end of the opening portion of the container body 11. The two holder portions 158 are formed so as to face each other making the center of the lid portion 157 as an axis. The holder portion 158 is a portion to accept and hold the aerosol valve 77. The structure of the holder portion 158 is not particularly limited, and is designed according to the aerosol valve 77.

The cover cap 153 consists of a cover portion 166 covering the valve holder 151 and the aerosol valve 77, and a cylindrical fixing portion 167 fixing the valve holder 151 and the outer container 141. The structure thereof is not particularly limited.

As the method for filling the pressurizing agent and the contents A, B into the discharge container 140, the piston 142 is accommodated in the container body 141, the pressurizing agent P is filled from above the piston 142. In this moment, since the blade portion 142*b* of the piston 142 exhibits working effects of the check valve allowing the downward fluid flow, the pressurizing agent P can be filled into the pressurizing space below the piston 142. After making sure that the piston 142 has moved up to the top, the opening portion of the container body 141 is closed with the valve assembly 146 which connects the first storage container 143 and the second storage container 144. At this moment, it is preferable to exhaust the pressurizing agent in the compressing space and to close. Then, the stem 77*a* of the aerosol valve 77 is opened, and the inside of the first storage container 143 and the second storage container 144 is exhausted. At the end, the first content A and the second content B are filled from the stem 77*a* while resisting the pressure of the pressurizing agent.

In the discharge product in which the content A, B are filled in this discharge container 140, using the push button 30 (an imaginary line of FIG. 1) which pushes the two stems 77*a* simultaneously, two stems 77*a* are pushed down to open the both aerosol valve 77, the both contents A, B are simultaneously discharged by being pressed by the pressurizing agent P.

Figure 19:
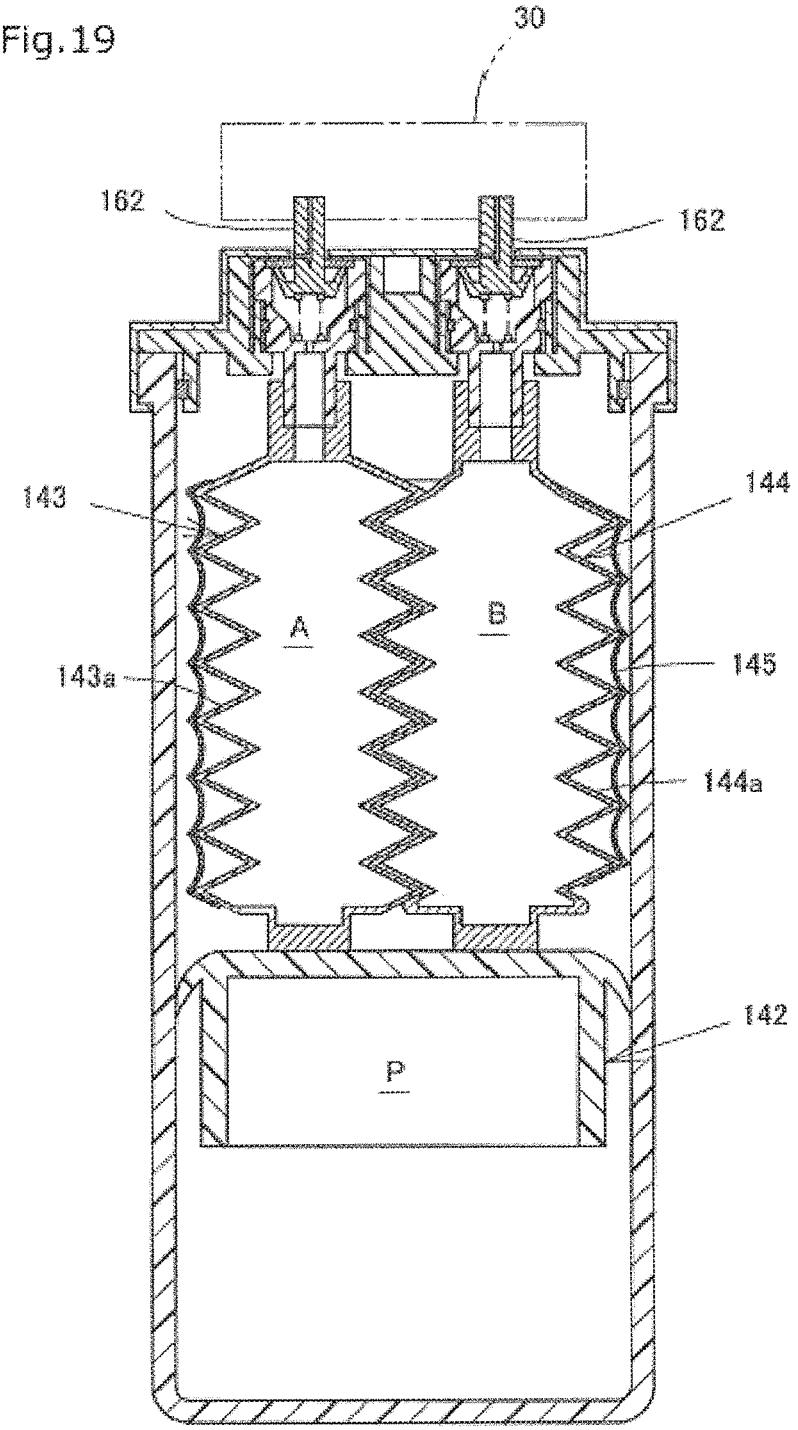
FIG. 19 is a cross-sectional view showing the operated state of the two-liquid discharge container of FIG. 18A.

Stated differently, by the both aerosol valve 77 being opened, the pressurizing agent P in the pressurizing space moves the piston 142 upward, consequently, the bottom portion 143*b* of the first storage container 143 and the bottom portion 144*b* of the second storage container 144 contacting the upper bottom portion 142*a* of the piston 142 moves upward. Thereby, the body portion (the first bellows portion) 143*a* of the first storage portion 143 and the body portion (the second bellows portion) 144*a* of the second storage container 144 contract in the state superimposed in parallel. At the same time, the both contents A, B are discharged outside from the stem 77*a* of the aerosol valve 77 through the push button 30 (refer to FIG. 19).

At this moment, since the piston 142 is integrated, the first storage portion 143 and the second storage portion 144 can be pressed simultaneously, each degree of contraction (moving distance of the bottom portion) can be made the same. Further, in this embodiment, since the first storage container 143 and the second storage container 144 contract as far as the identical length in the state superimposed in parallel, even if the resistance of the discharge passage of each container is different, two contents A, B can be made to be a constant discharge ratio more stably. For example, even if the viscosity of the two contents is different, it can also be made to be a constant discharge ratio. Moreover, even if either one of the valve connected with the first storage portion 143 and the second storage portion 144 is released by the inclining etc. of the push button 30, since the first storage portion 143 and the second storage portion 144 are in the state superimposed in parallel, it never occur that only either one content is discharged, In addition, by adhering or welding the mountain portion and the valley portion of the first storage portion 143 and the second storage portion 144, it becomes possible to maintain in the state superimposed in parallel, the contents can be discharged at a constant discharge ratio more stably.

Figure 20:
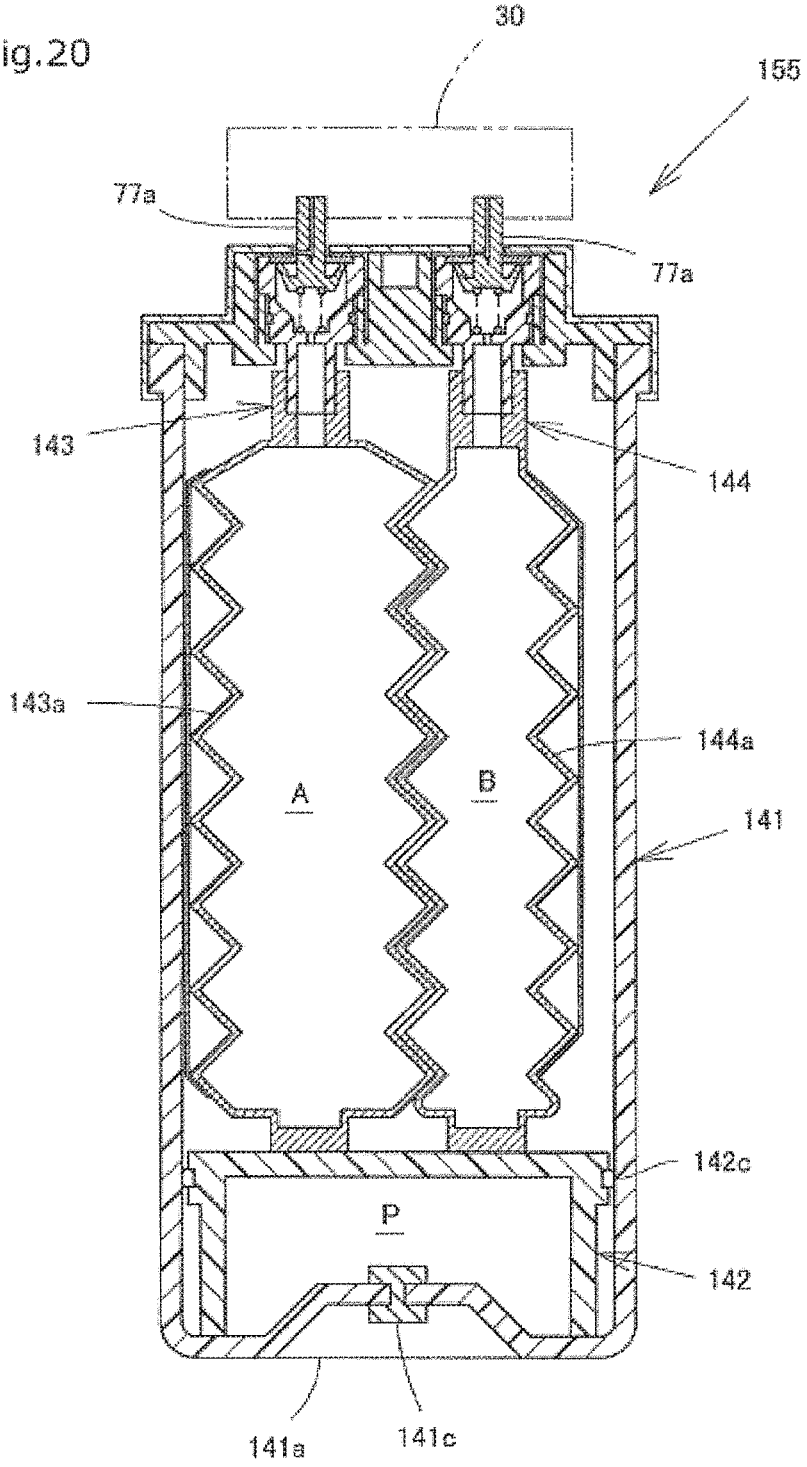
FIG. 20 is a cross-sectional view showing another embodiment of the two-liquid discharge container of vertically extending and contracting type of the present invention.

The two-fluid discharge container 155 of FIG. 20 is that in which the cross sectional area (volume) of the body portion 143*a* of the first storage portion 143 and the body portion 144*a* of the second storage portion 144 is different. Moreover, it is that in which a seal structure is not provided between the container body 141 and the valve holder 151. Hence, the vertical movement of the piston 142 becomes smoother than the two-fluid discharge container 140 of FIG. 18. Moreover, since a force is applied in a direction from bottom to top, in other words, in a direction only that the bellows portion is crushed vertically, the contents are easy to be discharged at an equal ratio. In this container body 141, a gas valve 141*c* for filling the pressurizing agent is provided in the bottom portion 141*a*. In the side surface of the piston 142, an O ring 142*c* is provided in place of the blade 142*b*. Hence, after assembling the discharge container 155, the pressurizing agent P is filled from the gas valve 141*c*, each content A, B can be filled from the stem 77*a* of the aerosol valve 77.

This discharge container 155 discharges the first contents A, B according to the discharge ratio of the body portion of each discharge container. It is preferable when the content of two-fluid-mixed type whose mixing ratio of the two fluids is different is used. By changing the cross sectional area of the bellows portion of the two storage containers as described above, the discharge ratio can be adjusted. In addition, the cross sectional area of the passage of the aerosol valve 77 (for example, the hole diameter of the stem 77*a* etc.) is adjusted according to the discharge amount. The other composition is same as the discharge container 140 of FIG. 18.

Figure 21A:
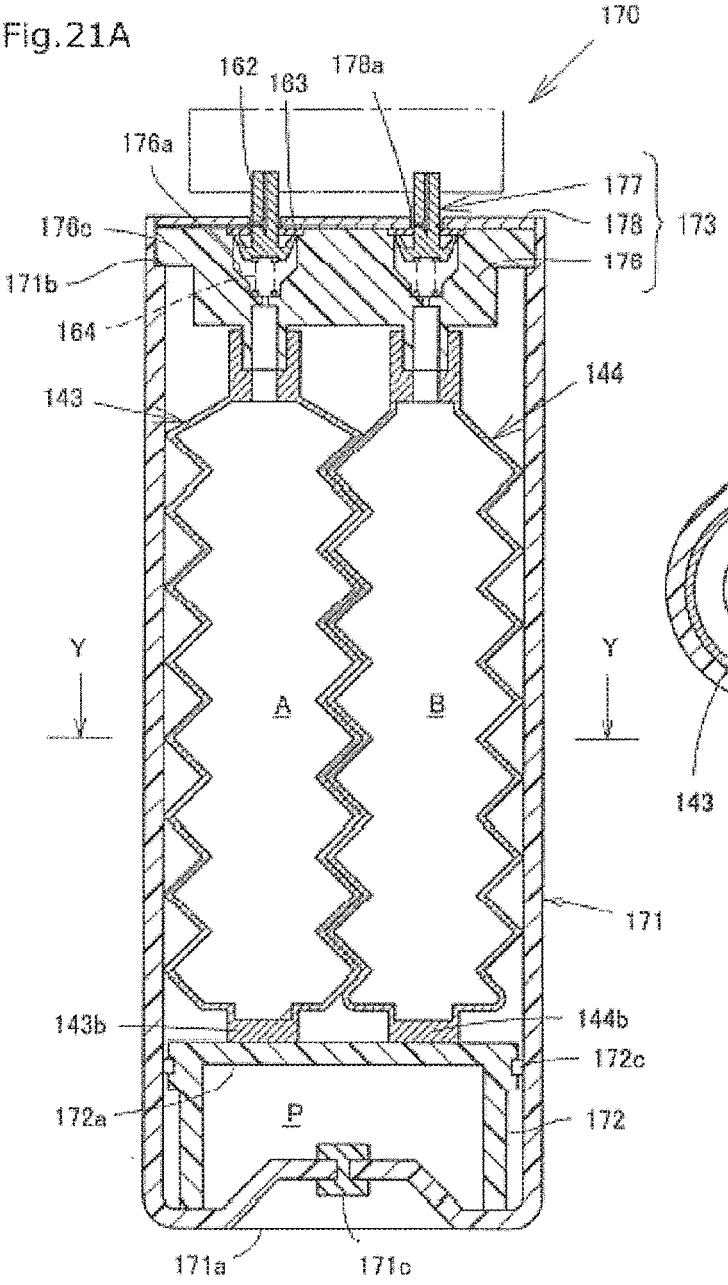
FIG. 21A is a cross-sectional view showing further another embodiment of the two-liquid discharge container of vertically extending and contracting type of the present invention.
Figure 21B:
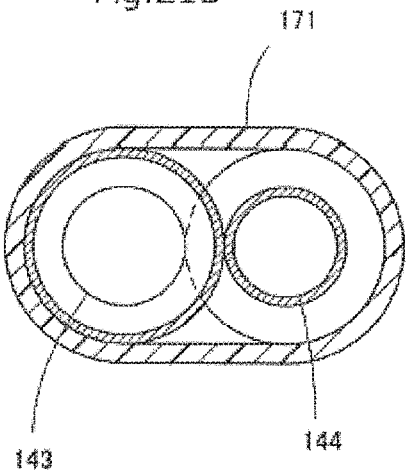
FIG. 21B is a Y-Y line cross-sectional view thereof.

The two-fluid discharge container 170 of FIG. 21A is that in which a container body 171 is made to be elliptical in place of the film maintaining the state superimposed in parallel of the storage container (refer to FIG. 21B). Therefore, since the outer periphery of the two storage containers contacts the inner periphery surface of the container body 171, even if the storage container contracts by actuating the stem and discharging contents, it is possible to prevent either one side only from inclining. It has the container body 171, a piston 172 which partitions the inside of the container body 171 into the compressing space and the pressurizing space, the first storage container 143 accommodated in the compressing space S1, the second storage portion 144 accommodated in the compressed space, a valve assembly 173 which closes the opening portion of the container body 171 and opens and closes the passage communicating the first storage container 143 and the second storage container 144 with the exterior. The first storage container 143 and the second storage container 144 are those which are substantially same as the discharge container 140 of FIG. 18, and are accommodated in the state superimposed in parallel.

By filling the first content A and the second content B into the first storage container 143 and the second storage container 144 of discharge container 170, it becomes a discharge product.

The container body 171 is a hard elliptic cylindrical body equipped with a bottom portion 171*a* (refer to FIG. 21B). In the inner upper end surface, a step portion 171*b* to accept the valve assembly 173 is formed. And, in the center of the bottom portion 171*a*, a gas valve 171*c* for filling the pressurizing agent is provided. The inner surface shape of the container body 171 is also of a somewhat larger shape than the outer surface shape of circumscribed ellipse of the first storage container 143 and the second storage container 144 in the state superimposed in parallel.

With this inner surface shape, the state superimposed in parallel of the first storage container 143 and the second storage container 144 is held. The container body 171 as described above is formed of synthetic resin such as polyethylene terephthalate, nylon.

The piston 172 is a hard elliptic cylindrical body equipped with an upper bottom 172*a* of an elliptical shape. In the side surface of the piston 172, an O ring 172*c* is provided in place of the blade. The O ring 172*c* slides on the inner surface of the container body 171 while maintaining a sealing effect, and partitions the inside of the container body 171 into the compressing space and the pressurizing space. It is that in which the upper bottom 172*a* presses the bottom portion 143*b* of the first storage container 143 and the bottom portion 144*b* of the second storage container 144.

The valve assembly 173 consists of a valve holder 176 which closes the opening portion of the container body 171, a valve mechanism 177 held by the valve holder 176, and a lid member 178 which fixes the valve mechanism 177 to the valve holder 176 and fixes the valve holder to the container body 171.

The valve holder 176 is of an elliptic columnar shape, and is inserted into the opening portion of the container body 171. The outer edge 176*c* of the valve holder 176 engages with step portion 171*b* of the container body 171. And, in the valve holder 176, two tubular holder portions 176*a* so as to penetrate vertically and to accept the valve mechanism 177 are formed. The two holder portions 176*a* are formed so as to face each other making the short axis of the valve holder 176 to be the center. In the holder portion 176*a*, an annular step portion 176*b* to support the valve mechanism 177 is formed.

The valve mechanism 177 consists of a stem 162 inserted so as to be freely movable vertically into the holder portion 176*a*, a stem rubber 163 closing the stem hole of the stem thereof, and a spring 164 energizing the stem 162 upward always. The stem 162, the stem rubber 163, and the spring 164 are substantially same as the parts of the aerosol valve 77 of the discharge container 70 of FIG. 10.

The lid member 178 is a flat plate of an elliptical shape, and is inserted into the opening portion of the container body 171 so as to cover the valve holder 176, and is that which is adhered or welded to the opening portion of the container body 171. The two stem communicating holes 178*a* are formed so as to face each other making the short axis of the lid member 178 to be the center. The lower surface of the lid member 178 supports the valve mechanism 177.

As the method for filling the pressurizing agent and the contents A, B, the contents A, B are filled in the first storage container 143 and the second storage container 144 respectively, it is connected to the valve assembly 176. Then, the piston 172 is accommodated in the container body 171, and the opening portion of the container body 171 with the valve assembly 176 to which the storage container is connected is closed. At the end, the pressurizing agent is filled from the gas valve 171*c* for gas filling. Moreover, after assembling the discharge container 170, the contents A, B may be filled from each stem 177*a*, and the pressurizing agent may be filled from the gas valve 171*c*.

In this discharge product in which the contents A, B are filled in the discharge container 170, using the push button 30 (an imaginary line) which pushes two stems simultaneously, two stems are pushed down releasing the both valve mechanism 177, and discharges the both contents A, B simultaneously. And, same as the discharge container 140 of FIG. 18, the pistons are integrated, and since the first storage container 143 and the second storage container 144 contract in the state superimposed in parallel, two contents A, B can be made to be a constant discharge ratio always.

The two-fluid discharge container of FIG. 18-FIG. 21 are all of cylindrical shape, but they may be of polygon. Particularly, when it is of tetragon, the engaging area of the bellows portion of the storage container can be made large, which is preferable.

The two-fluid discharge container of FIG. 1-FIG. 21 are all that which discharge two fluids at the same time, but the present invention is not particularly limited to the discharge container for two-fluid discharge.

More than three discharge containers are accommodated in the housing container, and by providing more than three aerosol valves or valve mechanisms of valve assembly, it can be made into a discharge container which can discharge more than three liquids. All the two-fluid discharge containers of FIG. 1-FIG. 21 premise that pressurizing agent is filled in the pressurizing space. However, other than the two-fluid discharge container of FIG. 9, in place of the pressurizing agent, a member energizing the piston in the direction to make the first storage portion and the second storage portion contract may be accommodated. As such a material, for example, an elastic member such as a spring can be presumable.

The invention claimed is:

1. A two-fluid discharge container, comprising:

a container body including a body portion which has one end which is an opening portion and another end having a bottom lid;

a piston accommodated in the container body partitioning the container body into a compressing space equipped with a first storage portion in which a first content is filled and a second storage portion in which a second content is filled, and a pressurizing space in which a pressurizing agent is housed; and a valve assembly which closes the opening portion of the container body, the valve assembly having a passage which communicates the first storage portion and the second storage portion with an exterior, wherein the piston is provided with a first pressurizing portion which pressurizes the first storage portion, a second pressurizing portion which pressurizes the second storage portion, and a connecting portion which connects the first pressurizing portion and the second pressurizing portion, wherein the first pressurizing portion is a first piston portion sliding within the first storage portion, and the second pressurizing portion is a second piston portion sliding within the second storage portion, wherein the first storage portion and the second storage portion are provided concentrically, wherein the first storage portion and the second storage portion are partitioned by the piston, wherein the container body has a first body portion, a second body portion whose inner diameter is greater than an inner diameter of the first body portion, and a step portion provided between those, wherein there is provided a sliding layer in an inner peripheral surface of the first body portion, wherein the sliding layer includes a slit on an outer periphery surface of the sliding layer such that the slit is provided between the inner periphery surface of the first body portion and the outer periphery surface of the sliding layer, wherein the sliding layer has 1) a first thickness between the outer periphery surface and an inner periphery surface of the sliding layer and 2) a second thickness between the outer periphery surface where the slit is disposed and the inner periphery surface of the sliding layer, the second thickness of the sliding layer being smaller than the first thickness of the sliding layer, wherein the slit serves as a communication passage that communicates the valve assembly and the second storage portion, the communication passage constituting a passage to communicate the second storage portion with the exterior, wherein the piston is a convex body provided with a tubular main body portion sliding on an inner surface of the sliding layer, and a flange portion sliding on an inner surface of the second body portion, being provided in an outer periphery of the main body portion, and a tip of the main body portion constitutes a first piston portion and the flange portion constitutes a second piston portion, and wherein the first content of the first storage portion and the second content of the second storage portion are simultaneously pressurized and discharged by the piston.

2. The two-fluid discharge container according to claim 1, wherein the first storage portion is a columnar space, the second storage portion is a tubular space, and the first storage portion is arranged within a center hole of the second storage portion in a planar view.

3. The two-fluid discharge container according to claim 1, wherein the first storage portion and the second storage portion are arranged so as to be deviated in an axial direction.

4. The two-fluid discharge container according to claim 1, wherein the tip of the main body portion is made up of materials different from the flange portion.

5. The two-fluid discharge container according to claim 1, wherein an outer periphery diameter r of the first storage portion in a center axis side and an outer periphery diameter R of the second storage portion in an outer side is in a relation expressed by the following formula:

[Mathematic Formula 1]

$$R=\sqrt{2\cdot r} \qquad \text{(Formula)}$$

6. The two-fluid discharge container according to claim 1, wherein there is provided a regulating mechanism to make constant the pressing pressure of the piston.

7. The two-fluid discharge container according to claim 1, wherein the valve assembly is equipped with a stem for two-fluid discharge having two independent passages.

8. The two-fluid discharge container according to claim 1, wherein the valve assembly is equipped with two stems.

* * * * *